US008863338B2

(12) United States Patent
Dzioba et al.

(10) Patent No.: US 8,863,338 B2
(45) Date of Patent: Oct. 21, 2014

(54) THERAPEUTIC SUPPORT DEVICE ALLOWING CAPILLARY BLOOD FLOW

(75) Inventors: David A. Dzioba, Frankenmuth, MI (US); Kenneth A. Wolf, Chesterfield Township, MI (US); Timthoy Wyrick, Quincy, IL (US)

(73) Assignee: TouchSensor Technologies, LLC, Wheaton, IL (US)

( * ) Notice: Subject to any disclaimer, the term of this patent is extended or adjusted under 35 U.S.C. 154(b) by 740 days.

(21) Appl. No.: 13/152,033

(22) Filed: Jun. 2, 2011

(65) Prior Publication Data

US 2012/0060294 A1 Mar. 15, 2012

Related U.S. Application Data

(60) Provisional application No. 61/350,842, filed on Jun. 2, 2010, provisional application No. 61/390,016, filed on Oct. 5, 2010.

(51) Int. Cl.
*A47C 27/10* (2006.01)

(Continued)

(52) U.S. Cl.
CPC ..... *A61G 7/05776* (2013.01); *A47C 27/081* (2013.01); *A61H 9/005* (2013.01);

(Continued)

(58) Field of Classification Search
CPC .... A47C 27/083; A47C 27/081; A47C 27/08; A47C 27/10; A61G 7/05769; A61G 7/05776; A61G 7/1021; A61G 7/015; A61G 2203/34; A61G 13/1265; A61G 13/08; A61H 9/0078; A61H 9/005; A61H 9/00; A61H 2201/1669; A61H 2201/5002; A61H 2201/5056; A61H 15/00

USPC ..... 5/655.3, 706, 710, 713, 644, 654, 944, 5/933, 934, 613; 601/90, 98, 115, 148, 601/149

See application file for complete search history.

(56) References Cited

U.S. PATENT DOCUMENTS

| | | | |
|---|---|---|---|
| 1,274,851 | A | 8/1918 | Bybd |
| 2,604,758 | A | 7/1952 | Swindler |

(Continued)

FOREIGN PATENT DOCUMENTS

| | | |
|---|---|---|
| DE | 4201460 | 7/1993 |
| EP | 0025701 | 3/1981 |

(Continued)

OTHER PUBLICATIONS

International Search Report and Written Opinion for Int'l Pat. Appl. No. PCT/US2011/038928, dated Nov. 11, 2011.

(Continued)

*Primary Examiner* — Robert G Santos
(74) *Attorney, Agent, or Firm* — Barnes & Thornburg LLP

(57) ABSTRACT

A therapeutic device that reduces localized subcutaneous pressure while allowing capillary flow in a medical setting is disclosed. The therapeutic device comprises one or more rows of first pressure-focusing points, one or more rows of second pressure-focusing points disposed between and/or adjacent to the one or more rows of first pressure-focusing points in an alternating arrangement, and at least one inflatable bladder that is configured to place at least one row of the one or more rows of first pressure-focusing points and the one or more rows of second pressure-focusing points in contact with an area on a patient's body when the bladder is inflated and to remove the at least one row of the one or more rows of first pressure-focusing points and the one or more rows of second pressure-focusing points from contact with the area on the patient's body when the bladder is deflated such that pressure can be applied to the area on the patient's body with the one or more rows of first pressure-focusing points and the one or more rows of second pressure-focusing points in an alternating manner.

21 Claims, 27 Drawing Sheets

(51) Int. Cl.

| | |
|---|---|
| ***A47C 27/08*** | (2006.01) |
| ***A61G 7/057*** | (2006.01) |
| ***A61H 9/00*** | (2006.01) |
| ***A61H 7/00*** | (2006.01) |
| ***A61G 13/12*** | (2006.01) |

(52) U.S. Cl.

CPC ..... *A47C 27/083* (2013.01); *A61H 7/001* (2013.01); *A61G 13/1265* (2013.01); *A61H 9/0078* (2013.01); *A61G 7/05769* (2013.01); *A47C 27/10* (2013.01); *Y10S 5/933* (2013.01); *Y10S 5/944* (2013.01)

USPC ..... 5/655.3; 5/710; 5/713; 5/933; 5/944; 601/148; 601/149

(56) References Cited

U.S. PATENT DOCUMENTS

| | | | | |
|---|---|---|---|---|
| 2,719,986 | A | 10/1955 | Rand | |
| 3,148,391 | A | 9/1964 | Whitney | |
| 3,199,124 | A | 8/1965 | Grant | |
| 3,303,518 | A | 2/1967 | Ingram | |
| 3,390,674 | A | 7/1968 | Jones | |
| 3,483,862 | A | 12/1969 | Takeuchi | |
| 3,674,019 | A | 7/1972 | Grant | |
| 3,678,520 | A | 7/1972 | Evans | |
| 3,701,173 | A | 10/1972 | Whitney | |
| 3,784,994 | A | 1/1974 | Kery | |
| 3,919,730 | A | 11/1975 | Regan et al. | |
| 3,970,077 | A | 7/1976 | Dahl | |
| 4,037,591 | A | 7/1977 | Sarno | |
| 4,175,297 | A | 11/1979 | Robbins et al. | |
| 4,267,611 | A | 5/1981 | Aguinick | |
| 4,391,009 | A | 7/1983 | Schild et al. | |
| 4,472,847 | A | 9/1984 | Gammons et al. | |
| 4,524,762 | A | 6/1985 | Schulman | |
| 4,559,656 | A | 12/1985 | Foster | |
| 4,653,130 | A | 3/1987 | Senoue et al. | |
| 4,799,276 | A * | 1/1989 | Kadish | 5/613 |
| 4,840,425 | A | 6/1989 | Noble | |
| D315,188 | S | 3/1991 | Thomas | |
| 4,999,861 | A | 3/1991 | Huang | |
| 5,010,608 | A | 4/1991 | Barnett et al. | |
| 5,035,016 | A | 7/1991 | Mori et al. | |
| 5,060,326 | A | 10/1991 | Oswald | |
| 5,103,518 | A | 4/1992 | Gilroy et al. | |
| 5,109,558 | A | 5/1992 | Di Blasi | |
| 5,117,518 | A | 6/1992 | Schild | |
| 5,135,282 | A | 8/1992 | Pappers | |
| 5,210,889 | A | 5/1993 | Wesemann et al. | |
| 5,235,710 | A | 8/1993 | Nagashima | |
| 5,243,723 | A | 9/1993 | Cotner | |
| D341,983 | S | 12/1993 | Wang | |
| 5,267,365 | A | 12/1993 | Walter | |
| 5,437,068 | A | 8/1995 | Fisher | |
| 5,447,491 | A | 9/1995 | Bellandi | |
| 5,487,196 | A | 1/1996 | Wilkinson et al. | |
| 5,542,136 | A | 8/1996 | Tappel | |
| 5,659,910 | A | 8/1997 | Weiss | |
| 5,678,265 | A | 10/1997 | Meyer | |
| 5,685,036 | A | 11/1997 | Kopfstein et al. | |
| 5,687,438 | A | 11/1997 | Biggie et al. | |
| 5,729,853 | A | 3/1998 | Thompson | |
| 5,755,000 | A | 5/1998 | Thompson | |
| 5,820,573 | A | 10/1998 | Ramos | |
| 5,901,393 | A | 5/1999 | Pepe et al. | |
| 5,963,997 | A | 10/1999 | Hagopian | |
| 5,970,550 | A | 10/1999 | Gazes | |
| 6,014,784 | A | 1/2000 | Taylor et al. | |
| 6,098,222 | A | 8/2000 | Hand et al. | |
| 6,151,740 | A | 11/2000 | Morimoto | |
| 6,178,578 | B1 | 1/2001 | Soltani et al. | |
| 6,216,299 | B1 | 4/2001 | Kohlman | |
| 6,241,695 | B1 | 6/2001 | Dabir | |
| 6,336,907 | B1 | 1/2002 | Dono et al. | |
| 6,378,152 | B1 | 4/2002 | Washburn et al. | |
| 6,383,153 | B2 | 5/2002 | Dabir | |
| D471,051 | S | 3/2003 | Cook | |
| D474,061 | S | 5/2003 | Cook et al. | |
| 6,668,405 | B1 | 12/2003 | Kohlman | |
| 6,687,935 | B2 | 2/2004 | Reeder et al. | |
| 6,689,077 | B2 | 2/2004 | Dabir | |
| 6,711,771 | B2 | 3/2004 | Cook et al. | |
| D490,635 | S | 6/2004 | Boso | |
| 6,823,549 | B1 | 11/2004 | Hampton et al. | |
| 6,829,797 | B2 | 12/2004 | Partian | |
| 6,910,238 | B2 | 6/2005 | Biggie et al. | |
| 6,912,749 | B2 | 7/2005 | Thomas et al. | |
| 7,037,278 | B2 | 5/2006 | Dabir | |
| 7,159,255 | B2 | 1/2007 | Piraino | |
| D537,287 | S | 2/2007 | Lau | |
| 7,191,482 | B2 | 3/2007 | Romano et al. | |
| 7,328,472 | B2 | 2/2008 | Chaffee | |
| 7,392,557 | B1 | 7/2008 | Kohlman | |
| 7,409,735 | B2 | 8/2008 | Kramer et al. | |
| 7,520,011 | B1 | 4/2009 | Liberkowski | |
| 7,562,409 | B2 | 7/2009 | Chan | |
| 7,740,015 | B2 * | 6/2010 | Hyde et al. | 128/845 |
| 7,784,130 | B2 | 8/2010 | Pile | |
| 7,789,086 | B2 * | 9/2010 | Hyde et al. | 128/845 |
| 8,215,311 | B2 * | 7/2012 | Hyde et al. | 128/845 |
| 2002/0133105 | A1 | 9/2002 | Dabir | |
| 2004/0231051 | A1 | 11/2004 | Jansen | |
| 2006/0117488 | A1 | 6/2006 | Hung et al. | |
| 2006/0150327 | A1 | 7/2006 | Jansen | |
| 2006/0217645 | A1 | 9/2006 | Lockamy | |
| 2007/0033738 | A1 | 2/2007 | Tu | |
| 2008/0034501 | A1 * | 2/2008 | Hyde et al. | 5/613 |
| 2008/0035156 | A1 * | 2/2008 | Hyde et al. | 128/845 |
| 2008/0040861 | A1 | 2/2008 | Ootayopas | |
| 2008/0178392 | A1 | 7/2008 | Chu | |
| 2008/0188781 | A1 | 8/2008 | Carkner et al. | |
| 2009/0193590 | A1 | 8/2009 | Hata | |
| 2010/0024132 | A1 | 2/2010 | Carlson et al. | |
| 2010/0205750 | A1 | 8/2010 | McCausland et al. | |
| 2010/0218315 | A1 * | 9/2010 | Hyde et al. | 5/613 |
| 2010/0263131 | A1 | 10/2010 | Kajiwara et al. | |
| 2011/0107521 | A1 | 5/2011 | Alder et al. | |
| 2012/0060294 | A1 * | 3/2012 | Dzioba et al. | 5/655.3 |

FOREIGN PATENT DOCUMENTS

| | | |
|---|---|---|
| GB | 2107197 | 4/1983 |
| GB | 2197192 | 5/1988 |
| WO | 03/022197 | 3/2003 |
| WO | 2004/096108 | 11/2004 |

OTHER PUBLICATIONS

International Search Report and Written Opinion for Int'l Pat. Appl. No. PCT/US2011/054982, dated Jan. 18, 2012.

* cited by examiner

THERAPEUTIC SUPPORT DEVICE ALLOWING CAPILLARY BLOOD FLOW

CROSS-REFERENCE TO RELATED APPLICATIONS

The present application claims priority from U.S. Provisional Application Ser. No. 61/350,842, filed Jun. 2, 2010, and U.S. Provisional Application Ser. No. 61/390,016, filed Oct. 5, 2010, the disclosures of which are hereby incorporated by reference.

FIELD OF THE INVENTION

The present invention is directed to a therapeutic support device that is configured to assist in the minimization of decubitus ulcers (that is, pressure ulcers) and methods of using same. The device can include one or more sets of support pins disposed on one or more corresponding load bars. Each load bar can be disposed on a corresponding inflatable bladder. The bladders can be inflated and deflated to raise and lower the corresponding load bars and pins. In operation, a user sits or lies on the therapeutic device and air or another fluid is admitted to and discharged from the bladders to respectively increase and decrease pressure applied by the device to the user's body. The pressure in individual bladders also can be changed in a manner enabling the pins to massage the patient and promote localized capillary and lymphatic blood flow. The level of control the device provides for pressure relief and massaging can be increased by increasing the number of bladders and/or zones and/or by adjusting the manner in which an associated control system regulates inflation and deflation of the bladders.

The device can be placed on a bed, operating table, imaging device, or other surface to provide pressure relief to a patient lying thereon. It may replace a mattress, pillow, or pad or it may be placed on top of a mattress, pillow, or pad. It may also be used with chairs, wheelchairs, and other load-bearing devices on which a user may be disposed for long periods of time.

BRIEF DESCRIPTION OF THE DRAWINGS

The attached drawings are part of the specification and represent certain embodiments of the present invention as well as their component parts. The components in the drawings are not necessarily to scale, emphasis instead being placed upon illustrating the principles of the present invention.

DETAILED DESCRIPTION OF THE ILLUSTRATED EMBODIMENTS

FIGS. 1-16 illustrate an exemplary device 100 (hereinafter sometimes referred to as a "bladder-pin device") that utilizes bladders 102A, 102B in conjunction with load bars 104A, 104B and elongated pins 106A, 106B to control pressure imparted by the device to a body supported thereon. Bladder-pin device 100 has an upper portion "A" disposed on top of a lower portion "B." Each of upper portion "A" and lower portion "B" includes respective bladders 102A and 102B, load bars 104A and 104B, and elongated pins 106A and 106B. This stacked configuration may allow elongated pins 106A, 106B to be spaced more closely together than might be practical in a device including only a single layer of elongated pins 106, and it may allow more bladders 102A, 102B to be utilized in a device having a given footprint, thereby allowing more precise and extensive pressure focusing and more complex patterns of pin movement. Other embodiments could include one or more additional portions including respective bladders 102*x*, load bars 104*x*, and elongated pins 106*x* similar to those included in upper portion A and/or lower portion B.

Elongated pins 106A, 106B rest on or are connected to load bars 104A, 104B, and load bars 104A, 104B rest on or are connected to bladders 102A, 102B. Load bars 104A, 104B serve to distribute loads applied to elongated pins 106A, 106B across bladders 102A, 102B and vice versa. Although load bars 104A, 104B could be omitted, the omission thereof would result in the loads applied to elongated pins 106A, 106B to be concentrated against corresponding points of bladders 102A, 102B, which could result in the need for bladders 102A, 102B to be operated at relatively higher pressures.

Figure 1:
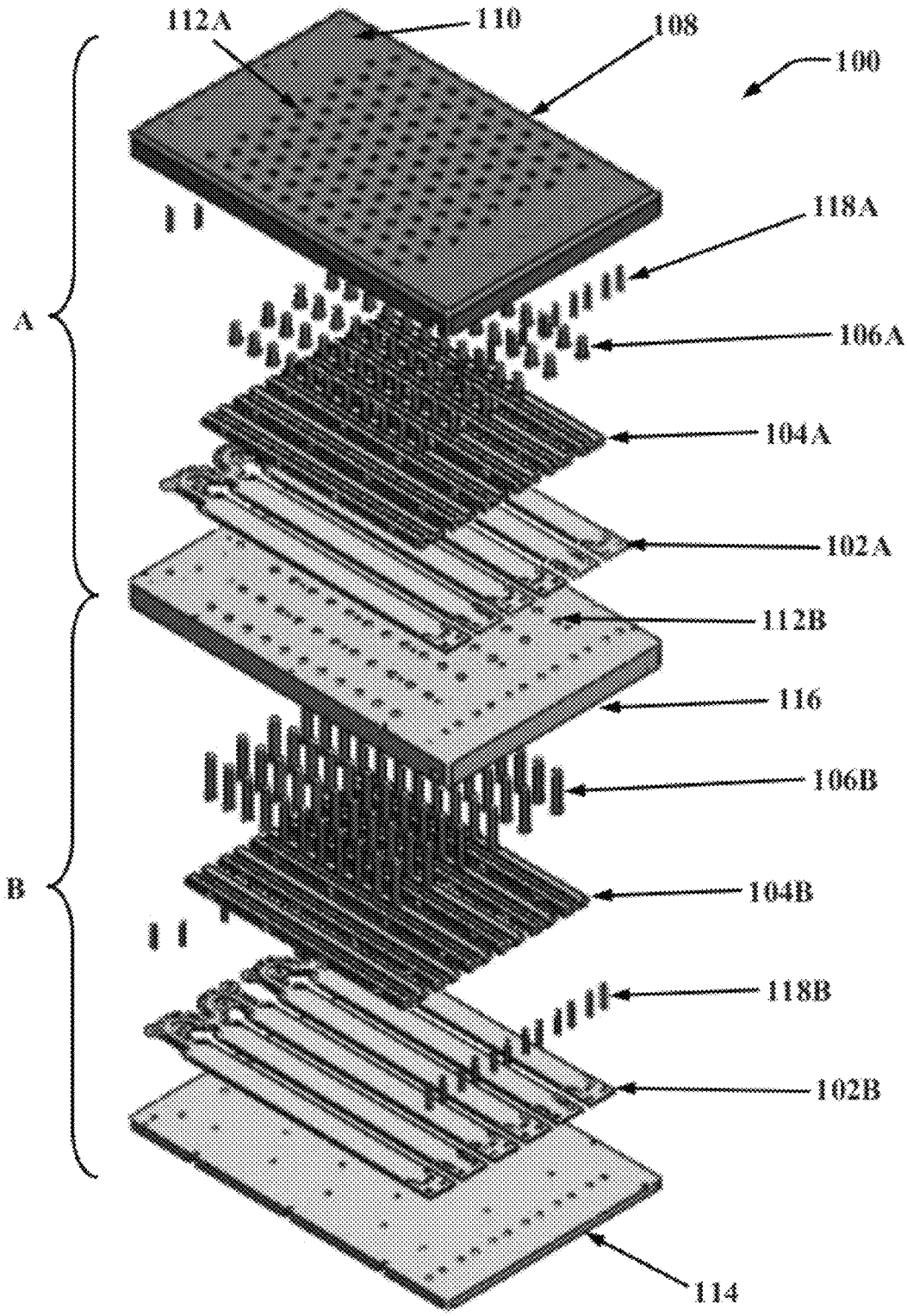
FIG. 1 is an exploded isometric view illustrating a multi-level therapeutic support device according to a non-limiting embodiment of the present invention.
Figure 2:
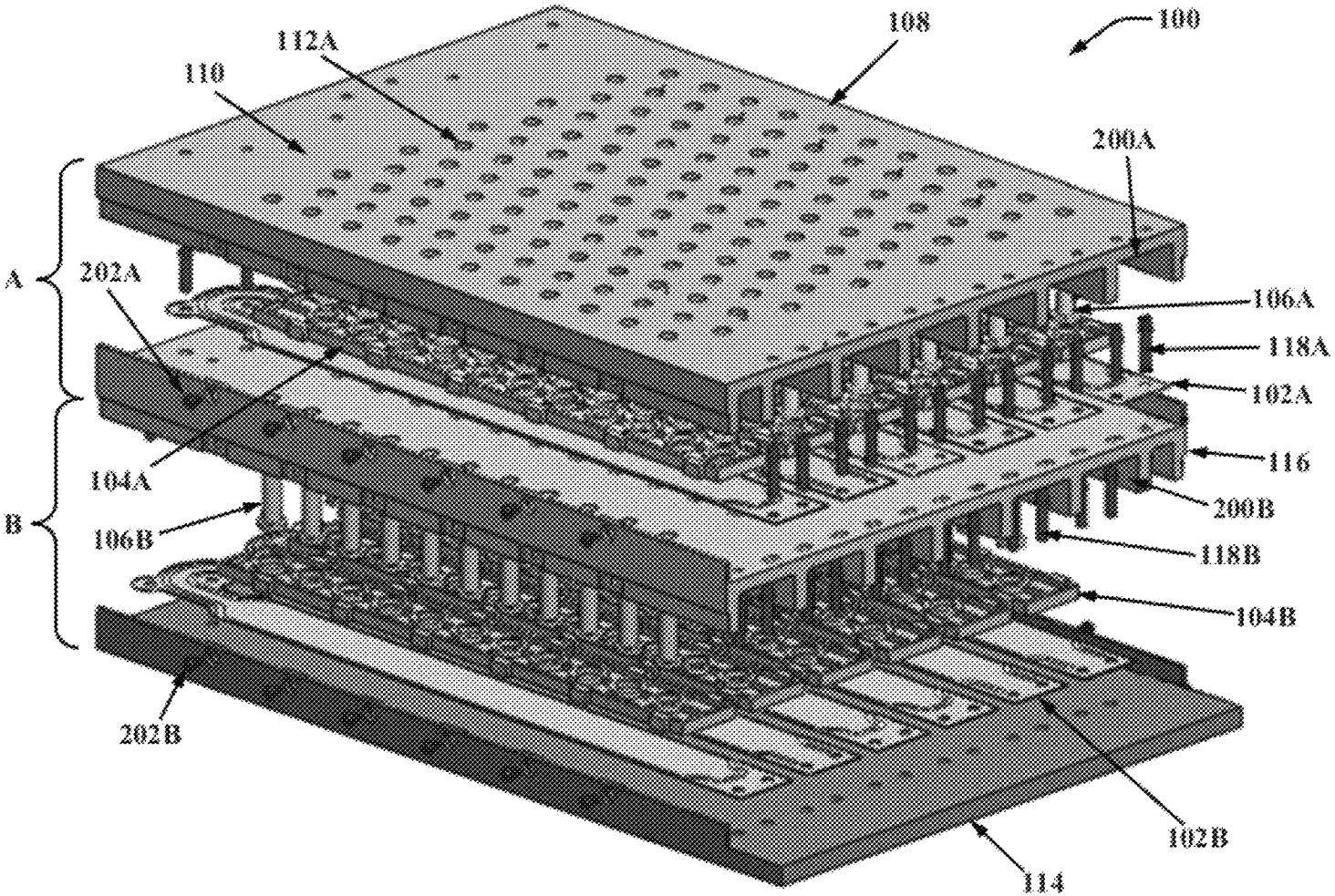
FIG. 2 is an exploded isometric view, taken in partial section, illustrating a multi-level therapeutic support device according to a non-limiting embodiment of the present invention.

As FIGS. 1-3 illustrate, upper portion "A" of bladder-pin device 100 includes a top stand-off 108 that defines the uppermost outer surface 110 of bladder-pin device 100 and that includes a plurality of openings 112A extending therethrough. Openings 112A are configured to slidably receive elongated pins 106A, 106B therein and are provided in a number sufficient to receive elongated pins 106A, 106B from both upper portion "A" and lower portion "B" of bladder-pin device 100. Top stand-off 108 also includes a plurality of channels 200A formed by pairs of vertical walls 300A extending downward from top stand-off 108. Each channel 200A is configured to slidably receive a load bar 104A.

As FIGS. 1-3 also illustrate, lower portion "B" of bladder-pin device 100 includes a base plate 114 that defines the bottom-most outer surface of bladder-pin device 100. Base plate 114 is substantially flat and supports bladders 102B of lower portion "B" of bladder-pin device 100, as well as a center stand-off 116. Like top stand-off 108, center stand-off 116 includes a plurality of openings 112B that are configured to slidably receive the elongated pins 106B therein. Openings 112B in center stand-off 116, however, need be provided in a number sufficient to receive only elongated pins 106B of lower portion "B" of bladder-pin device 100.

Also like top stand-off 108, center stand-off 116 includes a plurality of channels 200B formed by pairs of vertical walls 300B extending downward therefrom. Each of channels 200B is configured to slidably receive a corresponding load bar 104B. The top surface of center stand-off 116 is substantially flat and supports bladders 102A of upper portion "A" of bladder-pin device 100, as well as top stand-off 108. Center stand-off 116 is configured to be disposed between top stand-off 108 and base plate 114. Top stand-off 108 is attached to center stand-off 116 and center stand-off 116 is attached to base plate 114 using fasteners 202A, 202B, which may be screws or rivets. Alternatively, those components may be attached via any other suitable means, for example, vibration welding. Bladders 102A, 102B are aligned and held in place on base plate 114 and center stand-off 116 with alignment pins 118A, 118B installed on the base plate 114 and center stand-off 116.

As FIGS. 3-6 illustrate, load bars 104A, 104B may be provided in at least three different configurations. The first configuration, illustrated in FIGS. 3A and 4, includes a plurality of cylindrical receptacles 400 for receiving a cylindrical base portion 302 of an elongated pin 106A or 106B. The first configuration also includes a plurality of ribs 402 for increasing the strength and rigidity of the load bars 104A, 104B while allowing less material to be used to form the load bars 104A, 104B. The second configuration, illustrated in FIGS. 3B and 5, includes a guide groove 500 disposed therein along its longitudinal axis. Guide groove 500 is in the shape of an upside down "T" and is configured to receive the cylindrical base portion 302 of each of a plurality of elongated pins 106A, 106B. The third configuration, illustrated in FIGS. 3C and 6, includes a hold plate 600 and a rest plate 602 that are sandwiched together to hold cylindrical base portions 302 of elongated pins 106A, 106B therebetween. Hold plate 600 includes a plurality of stepped cylindrical openings (that is, counter-bores) 604, each having a cross-section in the shape of an upside down "T", extending there through, and each configured to receive a cylindrical base portion 302 of an elongated pin 106A or 106B.

In the second and third configurations, cylindrical base portion 302 can have a diameter slightly larger than the width of the thin part of the "T" (see, for example, FIGS. 3B and 3C) so that elongated pins 106A, 106B can be held securely to load bars 104A, 104B without the need for adhesive. Elongated guide groove 500 of the second configuration prevents vertical and lateral movement of elongated pins 106A, 106B when the pins are disposed therein. However, elongated pins 106A, 106B are slidably disposed in guide groove 500 to allow longitudinal movement, which allows load bars 104A, 104B and elongated pins 106A, 106B to be easily assembled and disassembled by sliding the pins in and out of guide groove 500. In contrast, each cylindrical opening 604 of the third embodiment holds only one elongated pin 106A, 106B and generally prevents more than a predetermined amount of vertical, lateral, and longitudinal movement thereof with respect to its corresponding load bar.

In both the second and third configurations, additional clearance can be provided between guide groove 500 and cylindrical openings 604 so elongated pins 106A, 106B can "float" a small amount in the guide groove 500 or cylindrical opening 604. That is, elongated pins 106A, 106B can slide in guide groove 500 in the longitudinal direction and have float in the vertical and lateral directions, and elongated pins 106A and 106B in cylindrical openings 604 can float in all three directions. The floating effect provided by this additional clearance allows elongated pins 106A, 106B to be more easily aligned and inserted through openings 112A, 112B in top stand-off 108 and center stand-off 116 during assembly of bladder-pin device 100. Moreover, the provision of at least one degree of movement for elongated pins 106A, 106B in the second and third configurations reduces the likelihood that the moving parts of the bladder-pin device 100 will bind during use, thereby potentially increasing its durability. The additional clearance provided in guide groove 500 and cylindrical openings 604 is preferably about 0.5 mm in each direction, although greater or lesser amounts of clearance may be provided as desired to facilitate the smooth assembly and operation of bladder-pin device 100.

Alternatively, elongated pins 106A, 106B may be attached to load bars 104A, 104B using any suitable mechanical connection or adhesive. Springs (not shown) may also be provided to hold elongated pins 106A, 106B in contact with load bars 104A, 104B. Such springs could bear against base portions 302 of elongated pins 106A, 106B and corresponding portions of top stand-off 108 or center stand-off 116. Load bars 104A, 104B may also be formed with any combination of the features illustrated in FIGS. 3-6, such as guide groove 500 of the second configuration combined with ribs 402 of the first configuration to increase strength and reduce material, or cylindrical receptacles 400 and ribs 402 of the first configuration (modified with holes for the elongated pins 106A and 106B to extend through) combined with rest plate 602 of the third configuration to hold elongated pins 106A, 106B in cylindrical receptacles 400.

Bladder-pin device 100 may also use a combination of different types of load bars 104A, 104B. For example, lower portion "B" of bladder-pin device 100 can be provided with load bars 104B illustrated in FIGS. 3A and 4, and upper portion "A" of bladder-pin device 100 can be provided with load bars 104A illustrated in FIGS. 3B and 5. Load bars 104A, 104B may be made from glass-filled nylon or glass-filled acytel, although other materials may be selected based on strength, weight, and durability requirements.

Figure 4:
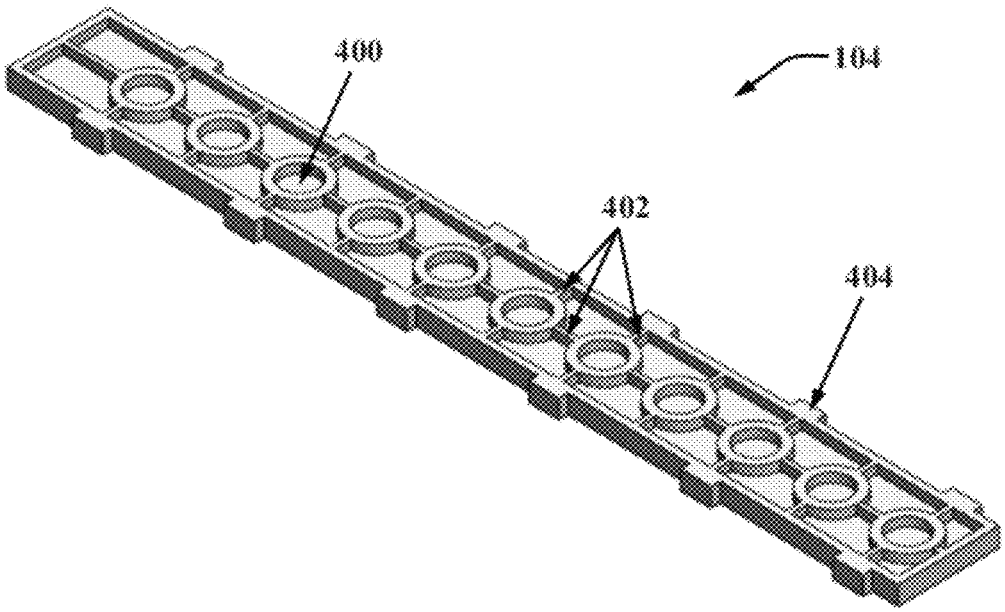
FIG. 4 is an isometric view of a load bar according to a non-limiting embodiment of the present invention.
Figure 5:
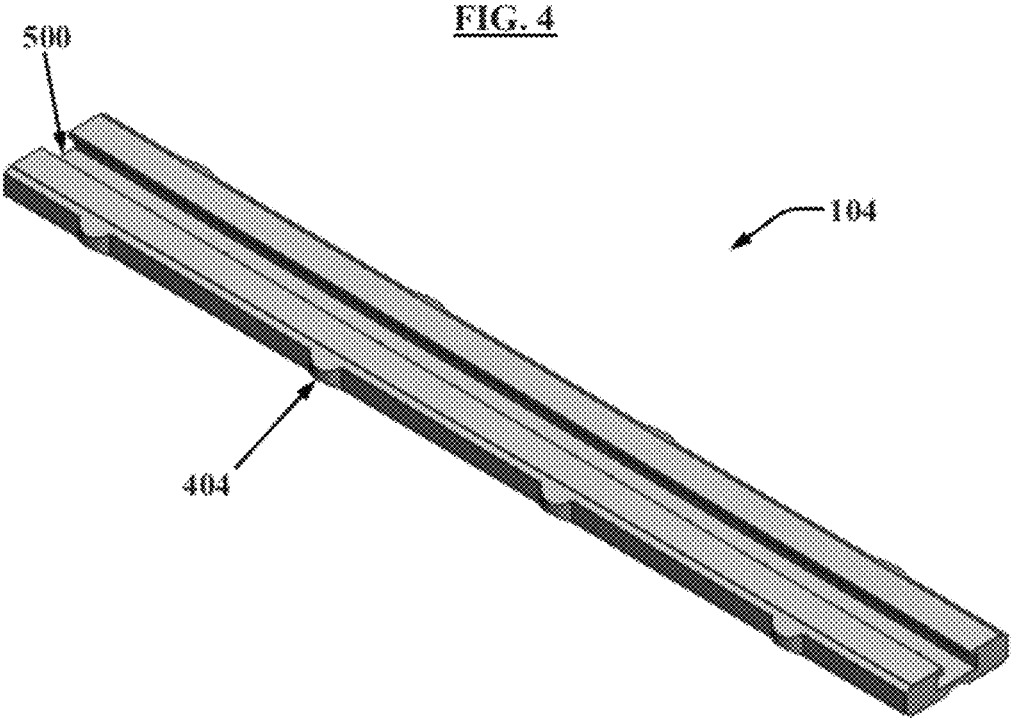
FIG. 5 is an isometric view of a load bar according to another non-limiting embodiment of the present invention.
Figure 6A:
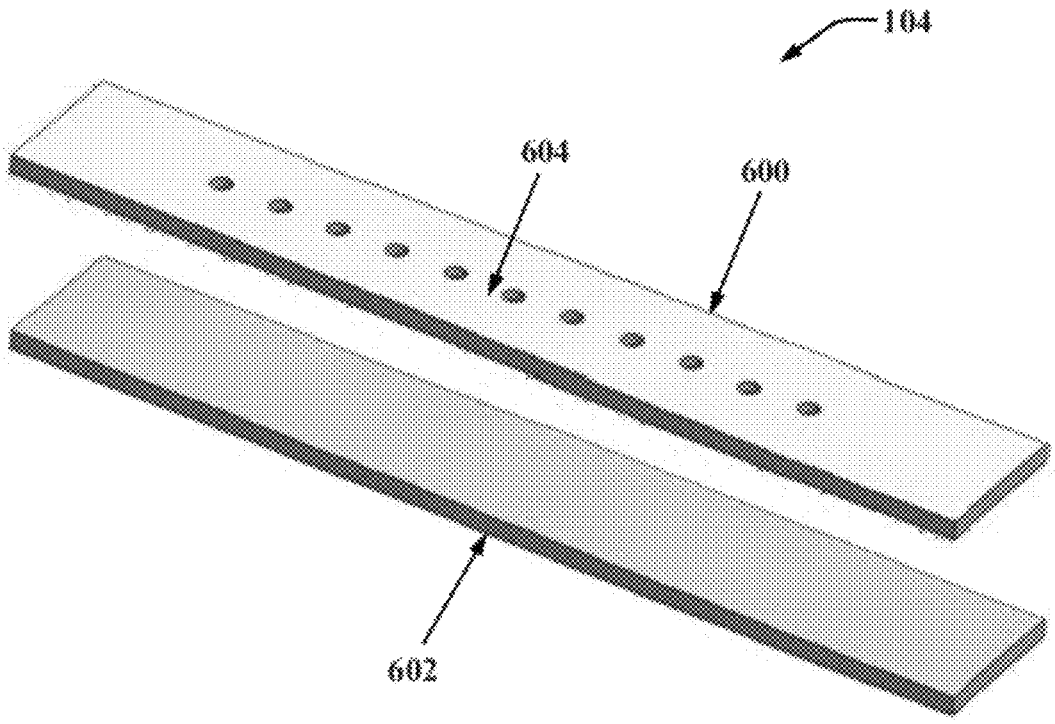
FIG. 6A is an isometric view of a load bar according to yet another non-limiting embodiment of the present invention.
Figure 6B:
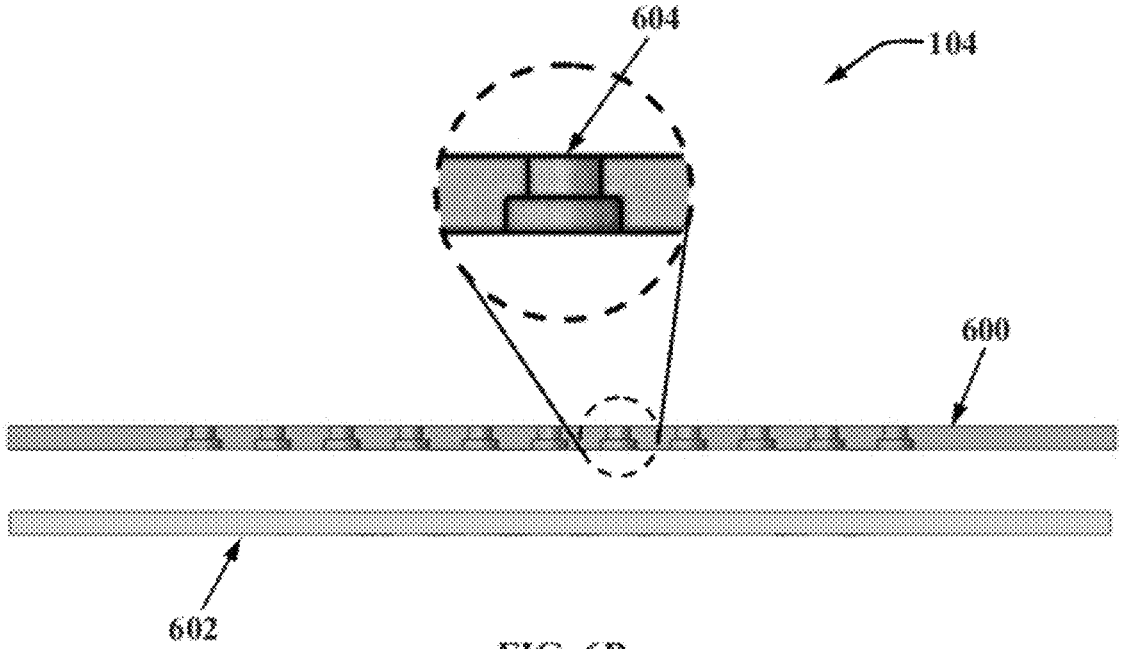
FIG. 6B is an elevation view, taken in section, of the load bar of FIG. 6A.

In FIGS. 4 and 5, the first and second embodiments of load bars 104A, 104B are respectively illustrated as including guiding protrusions 404 that guide load bars 104A, 104B as they are raised and lowered by bladders 102A, 102B such that load bars 104A, 104B move in a direction substantially parallel to the movement of elongated pins 106A, 106B. Although the third embodiment of load bars 104A, 104B illustrated in FIGS. 6A and 6B is not shown with guiding protrusions 404, it too may include guiding protrusions 404. The guiding protrusions 404 are configured to slidably engage corresponding grooves (not shown) in sidewalls 300A, 300B of channels 200A, 200B formed in top stand-off 108 and center stand-off 116. In FIG. 4, guiding protrusions 404 are shown as rectangular and, in FIG. 5, guiding protrusions 404 are shown as semi-circular. In other embodiments, guiding protrusions 404 and the corresponding grooves in which they slide can be of any suitable shape for slidable engagement.

When load bars 104A, 104B slide within channels 200A, 200B formed in top stand-off 108 and center stand-off 116, they apply a force to each elongated pin 106A, 106B being supported by corresponding bladder 102A and 102B with which the load is being applied. By constraining the movement of each load bar 104A, 104B to be axial with respect to elongated pins 106A, 106B, guiding protrusions 404 increase stability. Thus, load bars 104A, 104B can provide linear, simultaneous, and consistent actuation of elongated pins 106A, 106B.

Figure 7:
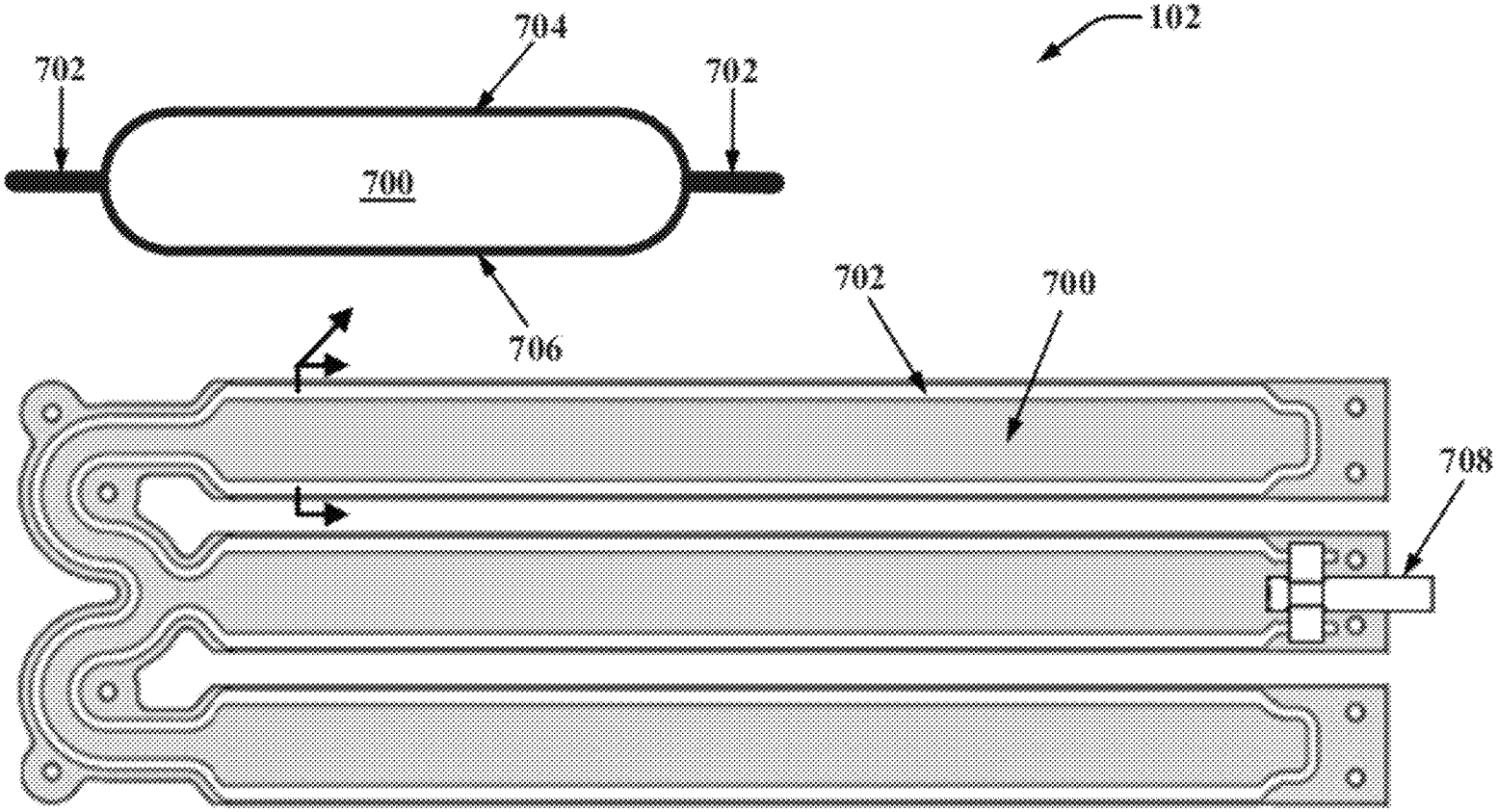
FIG. 7 is a plan view of a bladder, with a partial section view also shown, according to a non-limiting embodiment of the present invention.

As FIG. 7 illustrates, bladders 102A, 102B are formed substantially in the shape of a "W". Each branch, or arm, of the "W" is configured to fit within a corresponding channel 200A, 200B of top stand-off 108 or center stand-off 116 such that bladder 102A, 102B illustrated in FIG. 7 will fill three channels 200A, 200B in either top stand-off 108 or center stand-off 116. Bladders 102A, 102B may also be formed in any other suitable shape, such as in the shape of a "U", wherein each bladder would fill two channels 200A, 200B in either top stand-off 108 or center stand-off 116—one channel for each branch, or arm, of the "U". In other embodiments, each or either of bladders 102A, 102B could have more or fewer branches. Because top stand-off 108 and center stand-off 116 illustrated in FIGS. 1-3 each have six channels 200A, 200B, two bladders 102A, 102B are provided for each of those components to fill their respective channels 200A, 200B (that is, two W-shaped bladders 102A are provided to fill the six channels 200A of top stand-off 108 and two W-shaped bladders 102B are provided to fill the six channels 200B of center stand-off 116).

Figure 8:
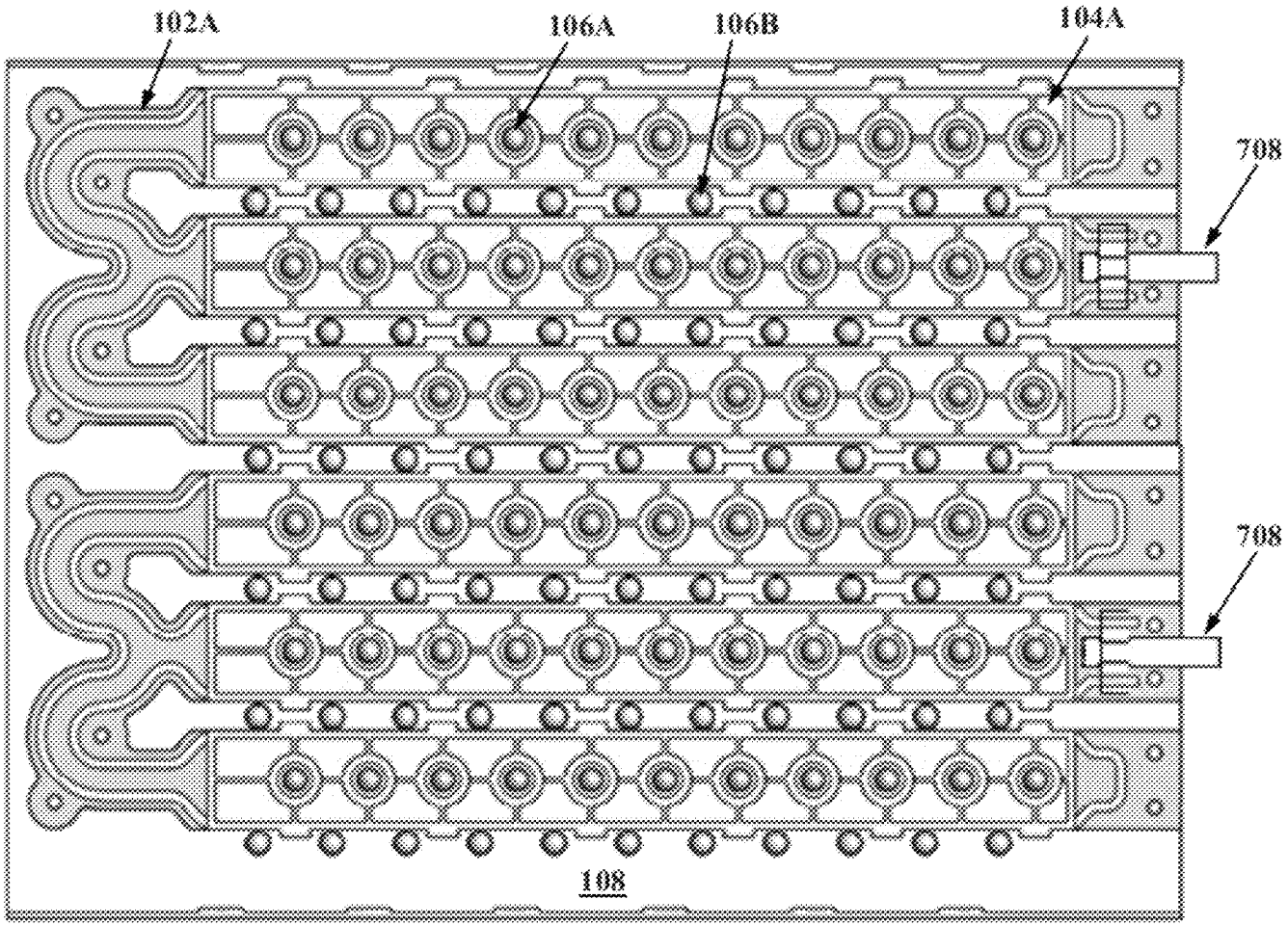
FIG. 8 is a plan view of the load bars of FIG. 4 installed on two of the bladders of FIG. 7.
Figure 9:
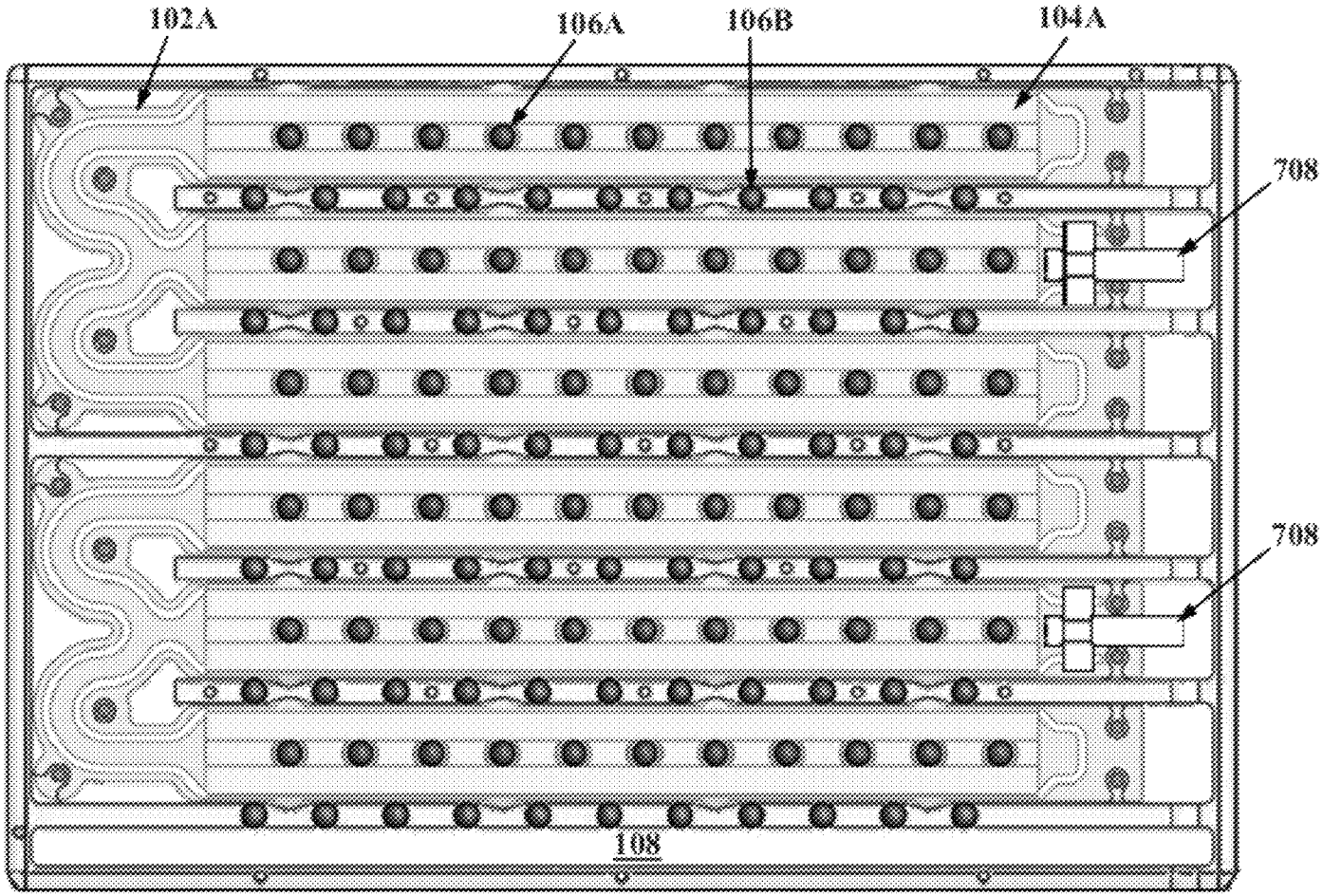
FIG. 9 is a plan view of the load bars of FIG. 5 installed on two of the bladders of FIG. 7.

Each bladder 102A, 102B includes an inflatable region 700 defined by seams 702 where an upper layer 704 and lower layer 706 of bladder material are fused together. The bladder material may be any suitable flexible material, such as rubber. Upper layer 704 can be fused to lower layer 706 using, for example, RF welding such that seams 702 are defined by the corresponding weld boundaries. Inflatable region 700 of each bladder 102A, 102B can be approximately the same width as a load bar 104A, 104B, as illustrated in FIGS. 8 and 9. FIG. 8 illustrates load bars 104A, 104B of FIG. 4 installed on a pair of bladders 102A, 102B, and FIG. 9 illustrates load bars 104A, 104B of FIG. 5 installed on a pair of bladders 102A, 102B.

Figure 3A:
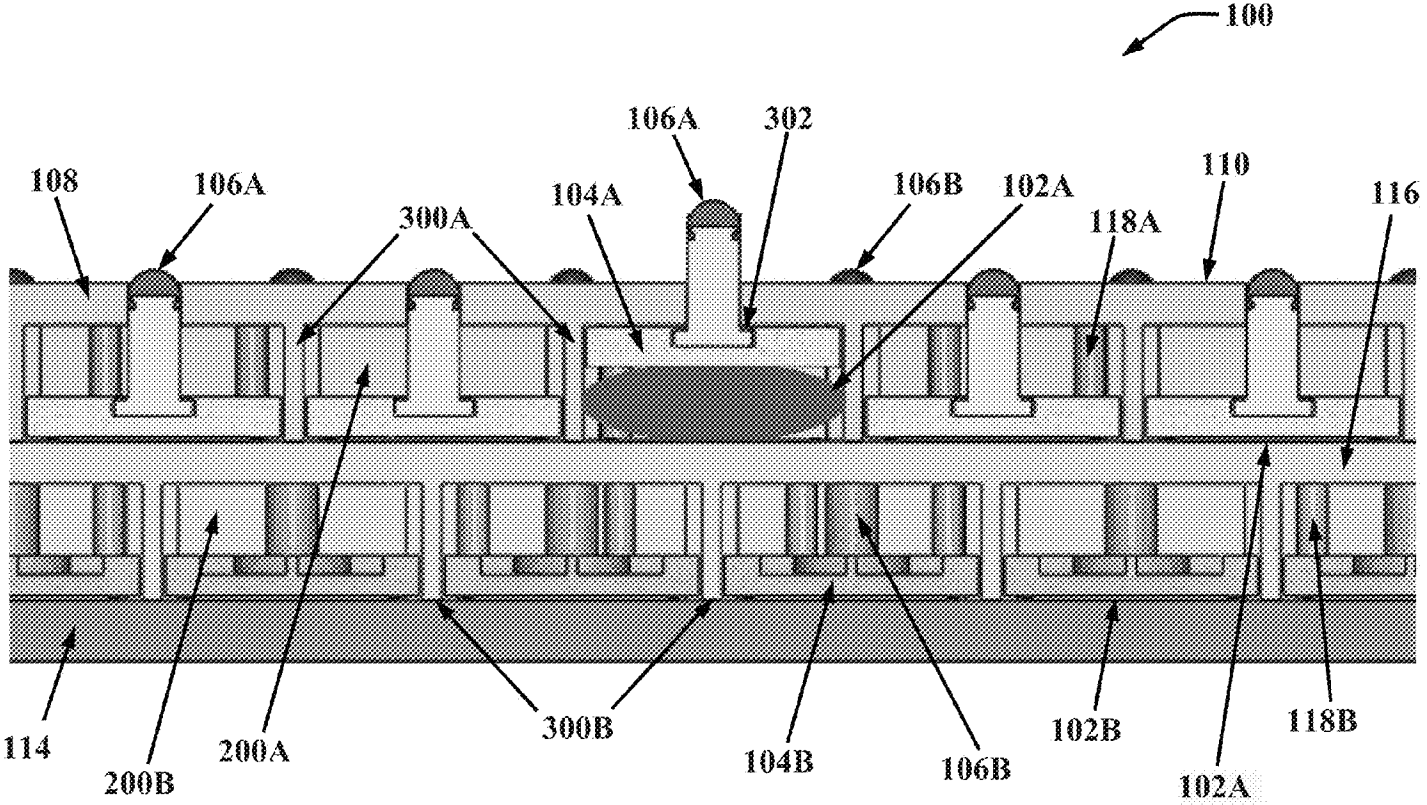
FIGS. 3A-3C are elevation views, taken in section, of the therapeutic device of FIG. 1 incorporating the load bars of FIGS. 4, 5, and 6, respectively.
Figure 3B:
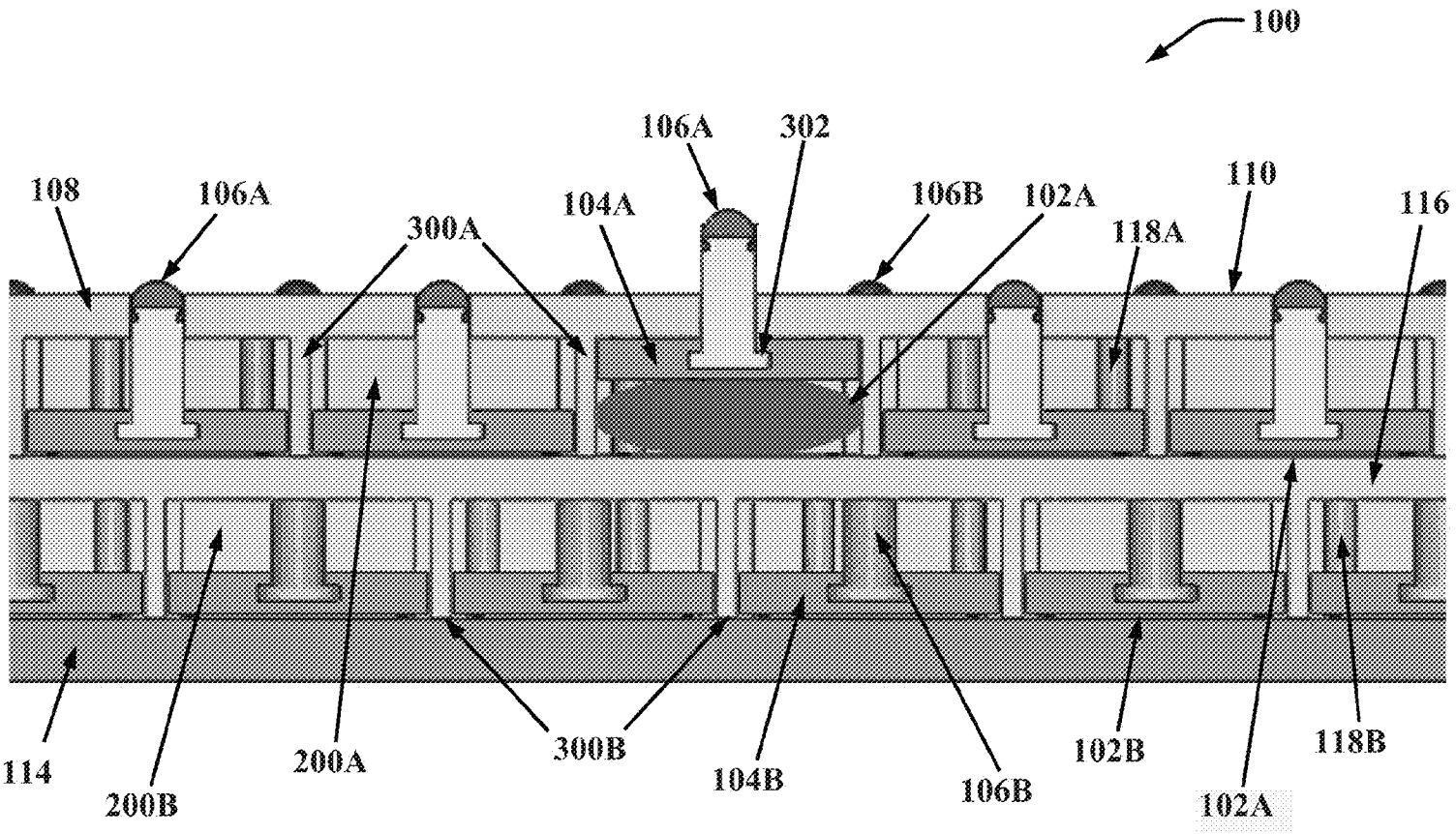
Figure 3C:
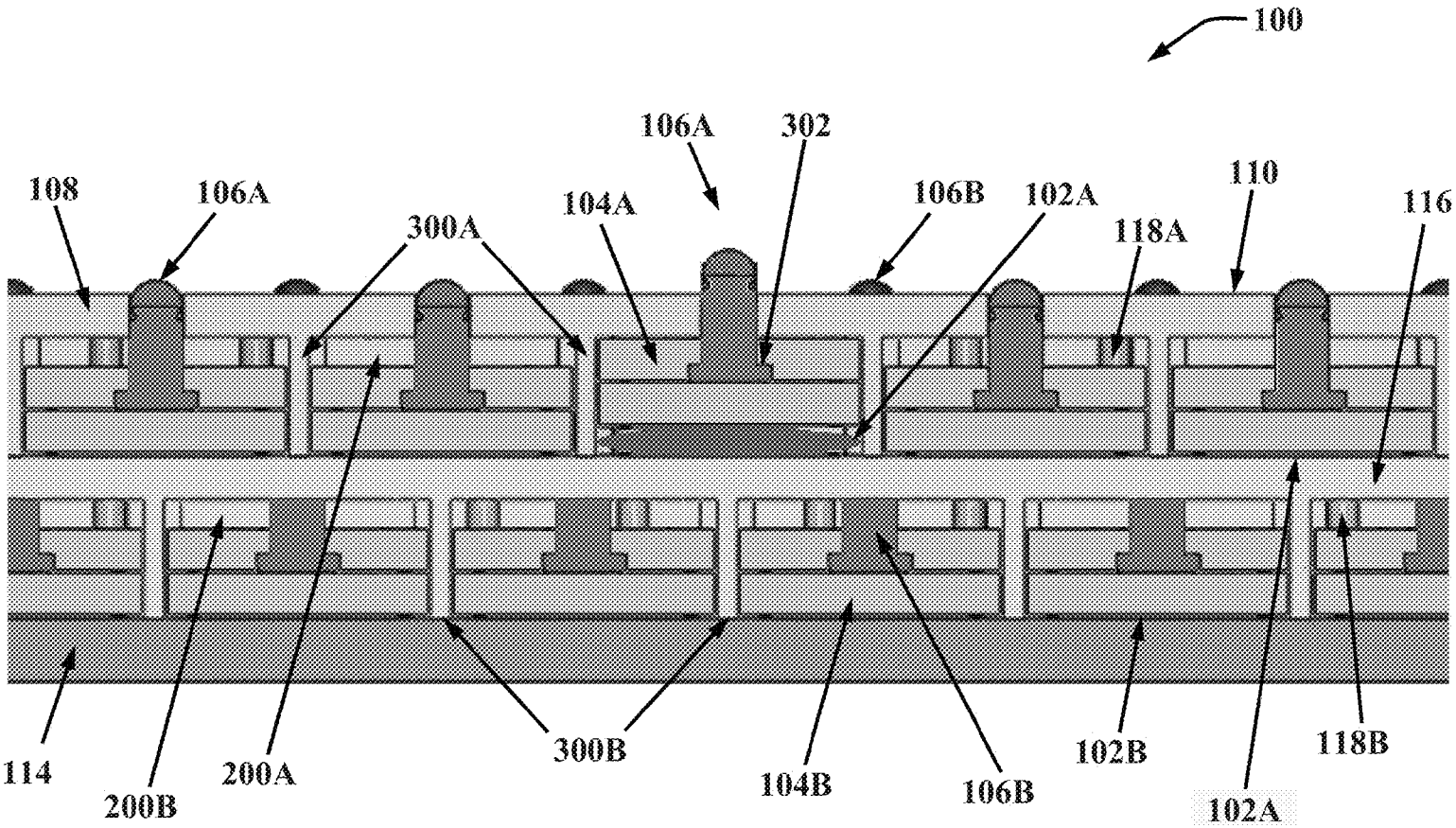

As FIG. 7 also illustrates, an inlet tube 708 is provided in fluid communication with the inflatable region 700 of bladders 102A, 102B so that the inflatable region 700 can be filled with air or some other fluid. As illustrated in FIGS. 3A-3C with respect to center bladder 102A, filling a bladder 102A, 102B with a fluid will cause the corresponding load bar 104A, 104B to raise so that the elongated pins 106A, 106B on that load bar 104A, 104B slide though the openings 112A, 112B and extend from upper-most surface 110 of bladder-pin device 100. Inflating bladders 102A, 102B causes load bars 104A, 104B and, therefore, elongated pins 106A, 106B, to travel linearly within channels 200A, 200B in a direction substantially perpendicular to upper-most 110 surface of bladder-pin device 100. Bladders 102A, 102B and channels 200A, 200B of top stand-off 108 and center stand-off 116 are configured to restrict the movement of elongated pins 106A, 106B to a distance from upper-most surface 110 of bladder-pin device 100 that is desirable to lift the user comfortably while still allowing for subcutaneous blood flow around each area of the user's skin where there is pin contact.

The use of inflatable bladders 102A, 102B to achieve that functionality provides a robust, non-caustic, low noise, and low cost mechanism for actuating elongated pins 106A, 106B. Although alternate mechanisms could be used for causing linear travel of elongated pins 106A, 106B, such mechanisms could be more costly, heavier, and likely to introduce contaminants into a hospital or other controlled setting in the event of maintenance or failure. Bladders 102A, 102B may be pneumatically or hydraulically actuated.

Elongated pins 106B provided in lower portion "B" are longer than elongated pins 106A provided in upper portion "A" so they can extend through both lower portion "B" and upper portion "A" and protrude from upper-most surface 110 of bladder-pin device 100. Elongated pins 106A, 106B move between actuated and non-actuated positions when bladders 102A, 102B are inflated and deflated, respectively. In the actuated position, elongated pins 106A, 106B extend a sufficient distance—preferably between 7.5 mm and 15 mm or a greater or lesser distance based on the application—from upper-most surface 110 of bladder-pin device 100 to provide focused pressure at the tips of elongated pins 106A, 106B. In the non-actuated position, elongated pins 106A, 106B may be substantially flush with the upper-most surface 110 of bladder-pin device 100, or may extend preferably 2 mm or less from the upper-most surface 110. Alternatively, in the non-actuated condition, elongated pins 106A, 106B may extend other distances (for example, 0 mm, 7.5 mm, or 15 mm) from upper-most surface 110 or be recessed within top stand-off 108. Accordingly, the length of elongated pins 106B provided in lower portion "B" should be sufficiently great that they can extend the same distance from upper-most surface 110 of bladder-pin device 100 as elongated pins 106A of upper portion "A" when those pins are in the actuated position.

Elongated pins 106A, 106B are particularly suited for supporting a user's weight while not diminishing subcutaneous blood flow between the pin contact points, thereby potentially reducing the likelihood of formation of a decubitus ulcer. To achieve that result, elongated pins 106A, 106B preferably have a diameter of about 8 mm, are spaced approximately 20 to 25 mm apart from each other. It is believed that such dimensions would yield a device that can maintain contact pressure in the interstices between the pins in contact with the user's body at about 26 to 32 mm Hg or less. (The contact pressure between pins in contact with the user's body could be as low as zero where that portion of the body is suspended between such pins or it could be higher than zero due to a hammocking effect in applications where a liner or sheet is disposed between device 100 and the user's skin.) Other dimensions and greater or lesser pressure may be provided as desired for particular applications and to accommodate certain parameters, such as the weight of the patient being supported. In an illustrative embodiment, bladder-pin device 100 can distribute weights of up to 400 pounds or more.

Elongated pins 106A, 106B may be of the type disclosed in, for example, U.S. Pat. Nos. 6,241,695, 6,383,153, 6,689,077, and 7,037,278, the disclosures of which are hereby incorporated by reference. Elongated pins 106A, 106B can be formed either of a single rigid material or a dual durometer material with soft tips for additional patient comfort. Elongated pins 106A, 106B can also be spring loaded to create a self leveling effect that matches a patient's various contours. Also, cam systems could be employed to further vary or control the pin movement.

In operation, different ones of elongated pins 106A, 106B can be actuated by inflating corresponding bladders 102A, 102B. As bladders 102A, 102B are inflated, inflatable regions 700 increase in diameter or thickness. Bladders 102A, 102B are trapped within channels 200A and 200B of top stand-off 108 and center stand-off 116, respectively, wherein load bars 104A, 104B rest on top of bladders 102A, 102B. When bladders 102A, 102B increase in diameter or thickness, they raise load bars 104A, 104B. Elongated pins 106A, 106B are attached on top of load bars 104A, 104B and extend from upper-most surface 110 of top stand-off 108 as load bars 104A, 104B are raised. When bladders 102A, 102B are deflated, load bars 104A, 104B return to their original depressed position, allowing elongated pins 106A, 106B to retract back into top stand-off 108. When moving between the non-actuated, depressed position to the actuated, inflated position, elongated pins 106A, 106B preferably travel 10 mm or more, but can travel greater or lesser distances depending on the application. Vacuum means and/or springs (for example, springs between top stand-off 108 and center stand-off 116 and their respective load bars 104A and 104B) may be provided and/or load bars 104A, 104B may be affixed to bladders 102A, 102B to assist in returning load bars 104A, 104B and elongated pins 106A, 106B to their original positions as bladders 102A, 102B are deflated.

Bladders 102A and 102B can be inflated in areas of the bladder-pin device 100 that correspond to a particular area of a user's body so that corresponding pins 106A, 106B can provide support to that area of the user's body. In this way, a user's weight in that area can be evenly distributed across actuated elongated pins 106A, 106B to preserve subcutaneous blood flow around areas of the body between such pins 106A, 106B. Subcutaneous blood flow could be further preserved, and perhaps even promoted, by actuating elongated pins 106A, 106B in a massaging pattern. For example, in the embodiments illustrated FIGS. 1-11, elongated pins 106B of lower portion "B" are provided in rows that are disposed between rows of elongated pins 106A of upper portion "A". Thus, by inflating and deflating bladders 102B in lower portion "B" in an alternating and progressive pattern with bladders 102A in the upper portion "A", an oscillating, wave-like pattern of movement can be created across elongated pins 106A, 106B to massage an affected area of a patient's body and to encourage localized capillary and lymphatic blood flow. Similar therapeutic effects may also be achieved by alternating the actuation of elongated pins 106A, 106B back and forth between upper portion "A" and lower portion "B" (for example, by inflating and deflating bladders 102A in upper portion "A" in unison with each other but alternately with bladders 102B in lower portion "B"). As disclosed above, a larger number of bladders 102A, 102B can be provided as required to increase the complexity of the patterns of movement of elongated pins 106A, 106B that can be created by inflating and deflating bladders 102A, 102B. Also, bladders 102A, 102B can be inflated and deflated in substantially any order that may be required to create a desired pattern of movement.

Figure 10:
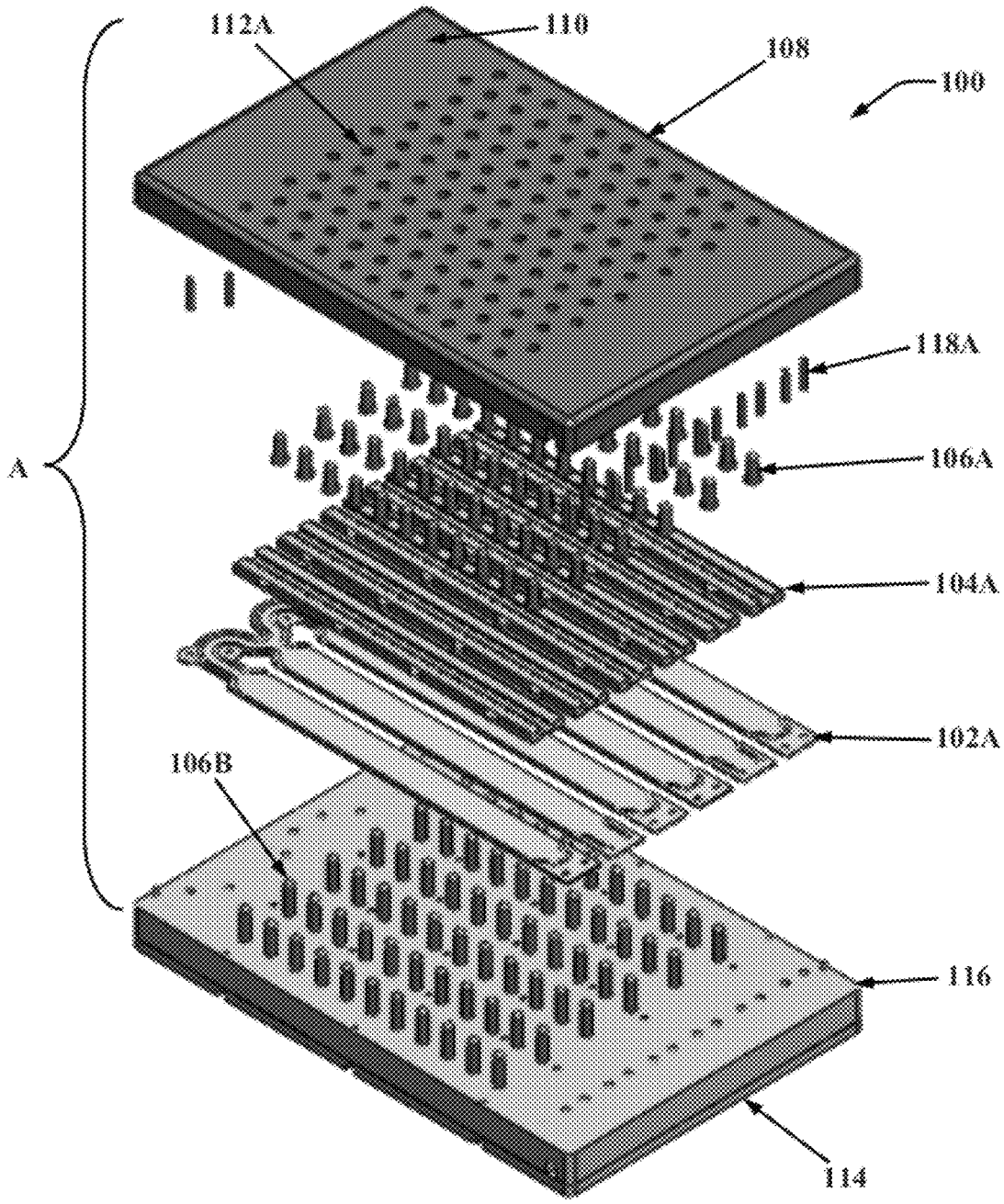
FIG. 10 is an isometric view of the therapeutic device of FIG. 1 with the upper portion shown exploded.
Figure 11:
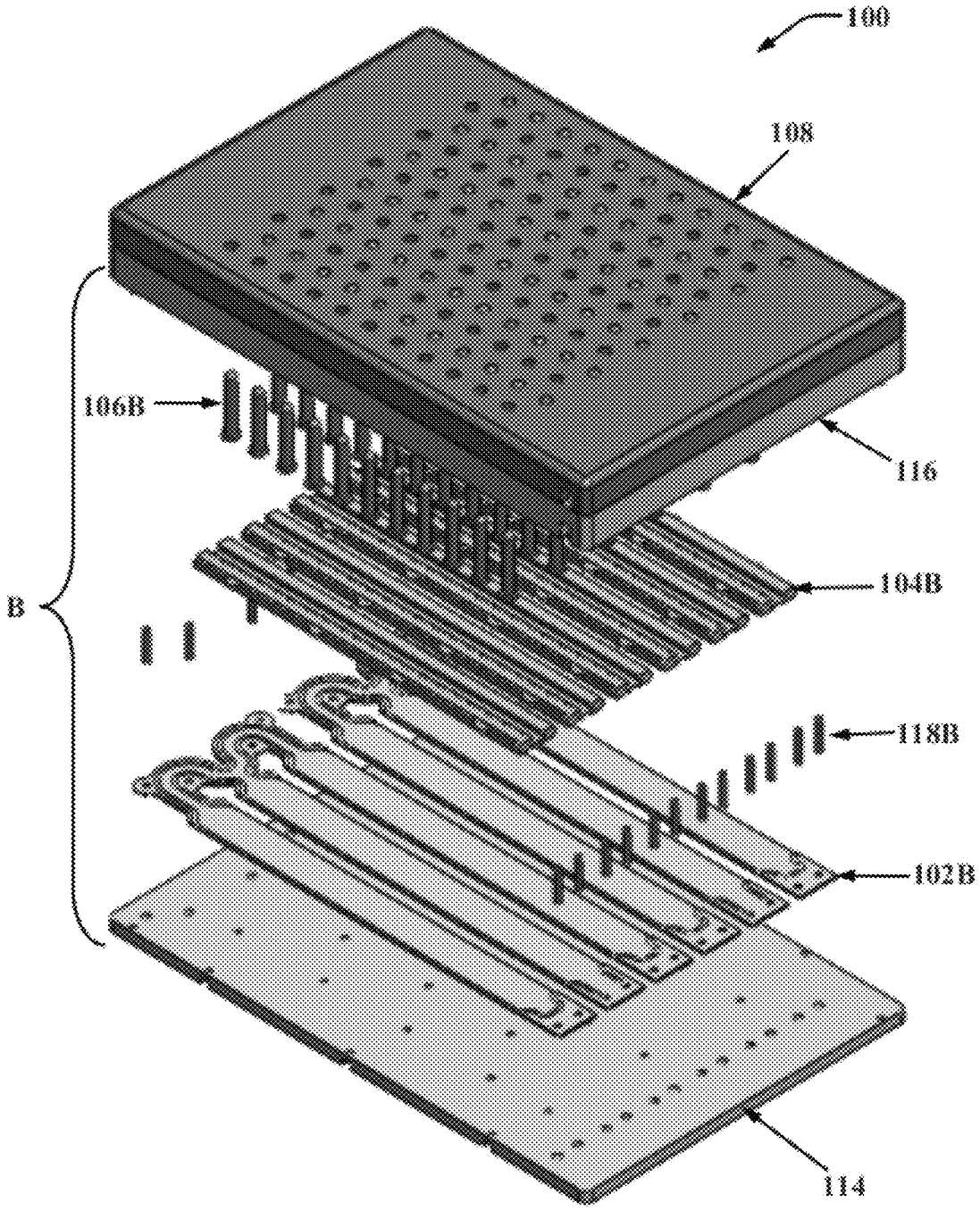
FIG. 11 is an isometric view of the therapeutic device of FIG. 1 with the lower portion shown exploded.
Figure 12:
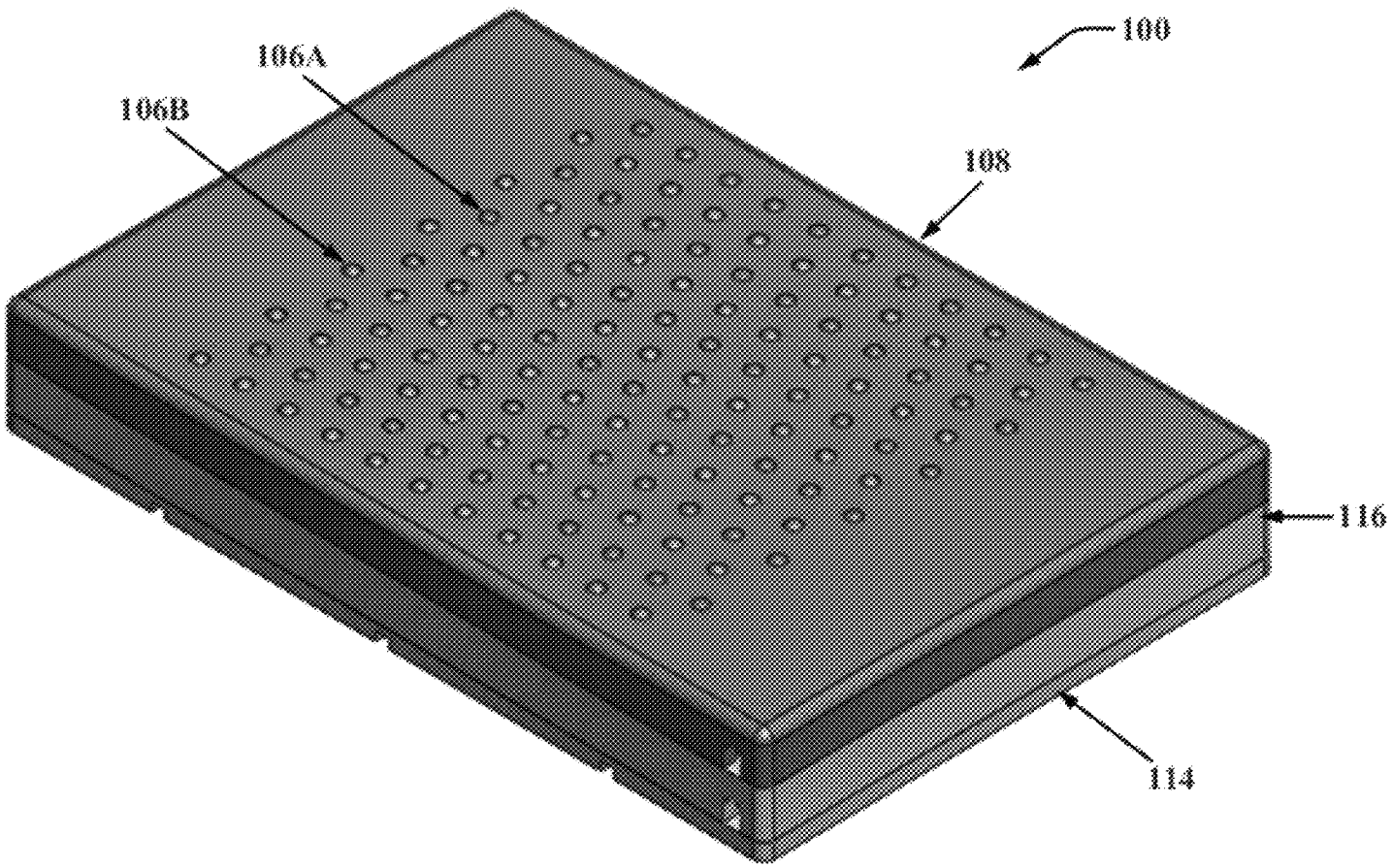
FIG. 12 is an isometric view of a multi-level therapeutic device, fully assembled.

FIG. 10 illustrates bladder-pin device 100 with upper portion "A" shown exploded, FIG. 11 illustrates bladder-pin device 100 with lower portion "B" shown exploded, and FIG. 12 illustrates a fully assembled multi-level bladder-pin device 100. As those figures illustrate, upper portion "A" and lower portion "B" of bladder-pin device 100 utilize many of the same components (for example, bladders 102A, 102B, load bars 104A, 104B, and elongated pins 106A, 106B) and are assembled in substantially the same manner. Accordingly, bladder-pin device 100 can be assembled in different configurations using the same components. For example, base plate 114 can be used in place of center stand-off 116 in upper portion "A" to assemble a single-level bladder-pin device 100 using primarily the components of upper portion "A", and top stand-off 108 can be used in place of center stand-off 116 in lower portion "B" to assemble a single-level bladder-pin device 100 using primarily the components of lower portion "B". An example of such a single-level bladder-pin device is shown, fully assembled, in FIG. 13. Both the multi-level and single-level bladder-pin devices 100 are preferably configured as modular units that can be combined in any suitable manner to fit multiple bed shapes and other applications.

Figure 13:
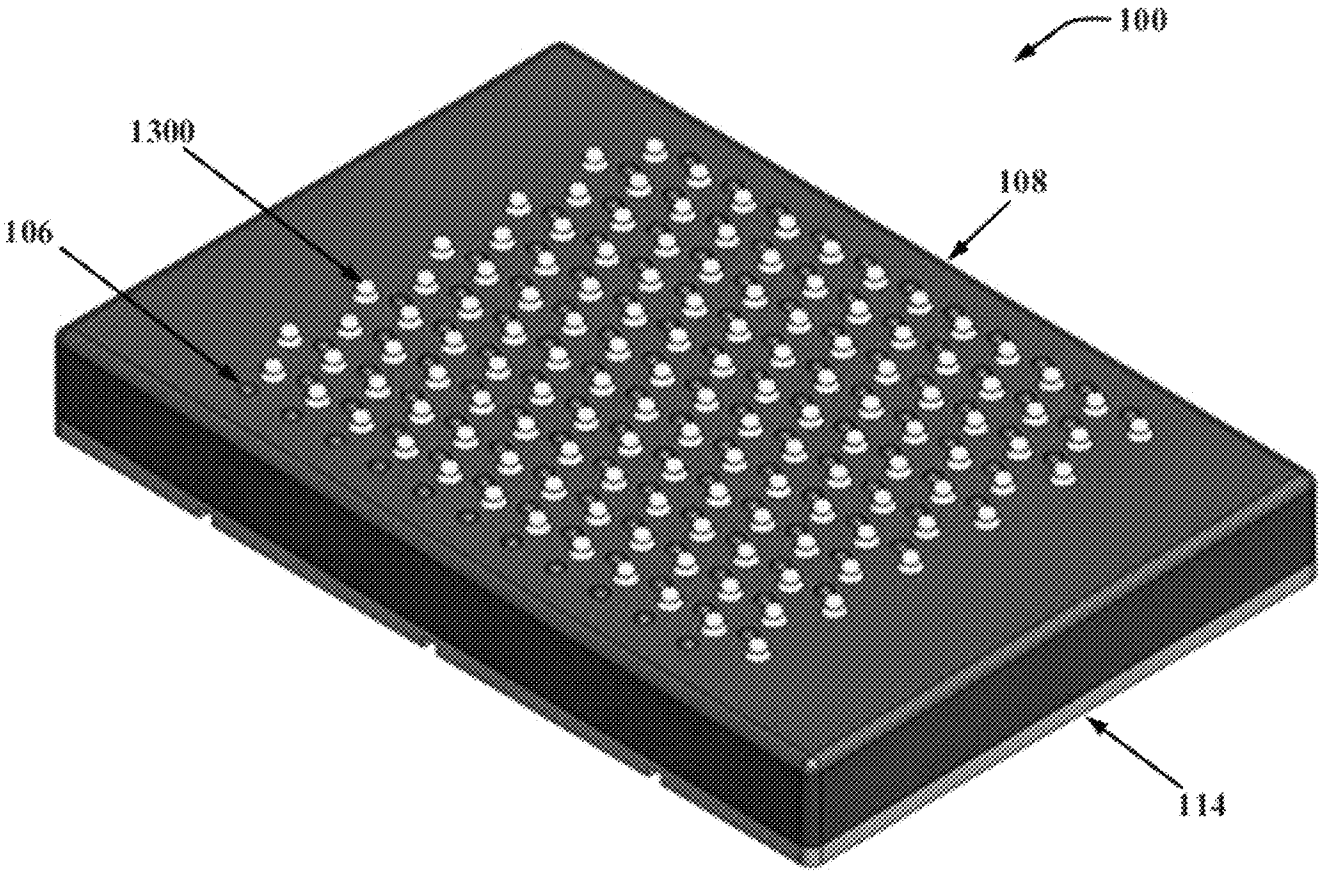
FIG. 13 is an isometric view of an illustrative embodiment of a single-level therapeutic device, fully assembled.

When bladder-pin device 100 is assembled as a single-level device, the density of the pin configuration can be maintained by providing rows of non-moving, static pins 1300 between rows of bladders 102 and load bars 104. As FIG. 13 illustrates, static pins 1300 are disposed in rows on upper-most surface 110 of top stand-off 108 between rows of elongated pins 106 that extend through top stand-off 108. Static pins 1300 preferably extend approximately 7.5 mm from upper-most surface 110 of top stand-off 108. Elongated pins 106 preferably are movable between a distance of 2 mm and 15 mm from upper-most surface 110 of top stand-off 108 such that they can be made longer or shorter than static pins 1300 by inflating and deflating bladders 102. In other embodiments, static pins 1300 and elongated pins 106 can have other dimension and can be spaced differently. In some single-level embodiments, static pins 1300 can be omitted. (Conversely, though not shown in the drawings, static pins 1300 could be included in certain multi-level embodiments, as well.)

Figure 14A:
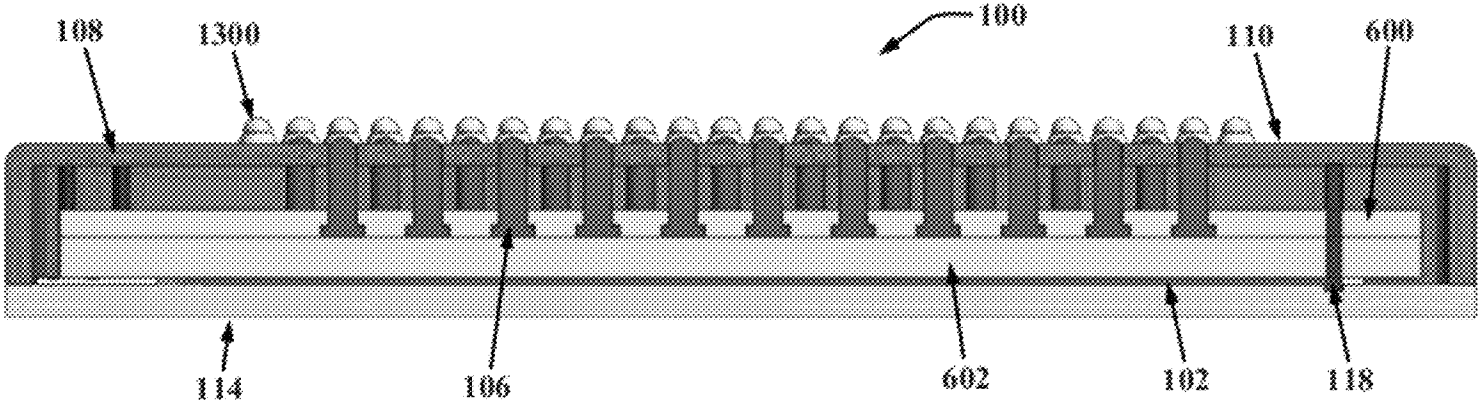
FIGS. 14A and 14B are elevation views, taken in section, of an illustrative embodiment of a single-level therapeutic support device according to a non-limiting embodiment of the present invention.
Figure 14B:
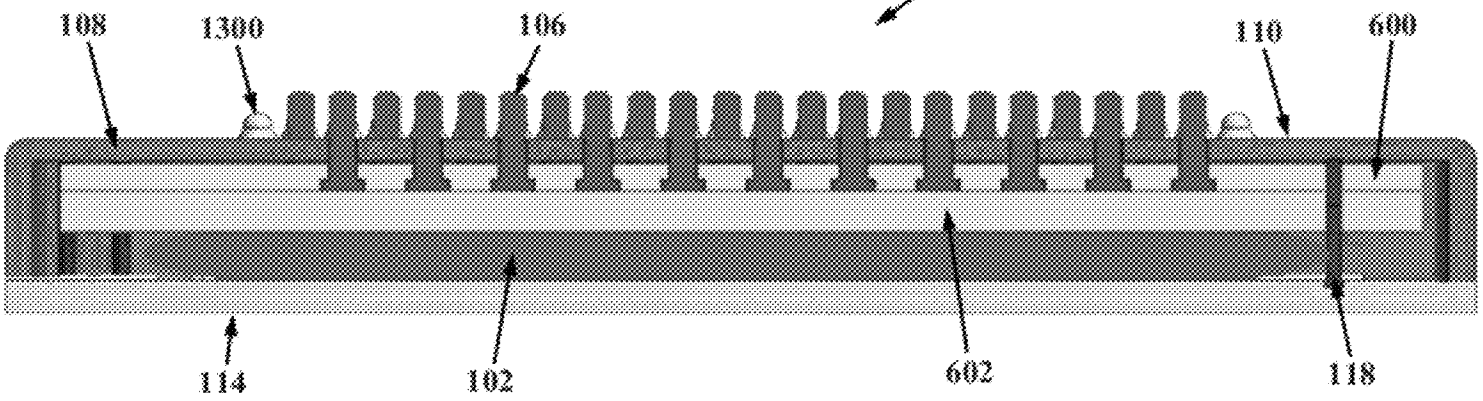

As FIGS. 14A and 14B illustrate, elongated pins 106 in a single-level bladder-pin device 100 can be installed between a load bar 104 comprising a hold plate 600 and a rest plate 602 (for example, the load bar 104 of FIGS. 6A and 6B) and raised and lowered with the same form of bladder 102 used in the multi-level bladder-pin device 100 (for example, bladder 102 of FIG. 7). FIG. 14A illustrates single-level bladder-pin device 100 with bladder 102 deflated, and FIG. 14B illustrates single-level bladder-pin device 100 with bladder 102 inflated. When bladder 102 is deflated, load bar 104 (that is, items 600 and 602 from FIGS. 6A and 6B) is disposed at the bottom of the channel 200 (see FIG. 3C) in which it slides so that static pins 1300 extend from upper-most surface 110 of top stand-off 108 by a distance greater than the extended length of elongated pins 106. In that configuration, static pins 1300 but not elongated pins 106 provide focused pressure to a patient's affected body area. When bladder 102 is inflated, elongated pins 106 slide through openings 112 in top stand-off 108 to a position above upper-most surface 110 of top stand-off 108 beyond the position of the heads of static pins 1300. In that configuration, elongated pins 106 but not static pins 1300 provide focused pressure to a user's affected body area. Also, bladder 102 can be inflated to an intermediate position so that the heads of static pins 1300 and elongated pins 106 extend substantially the same distance from the upper-most surface 110 of the top stand-off 108 so that all of the pins provide focused pressure to a patient's affected body area.

The inclusion of static pins 1300 in rows between bladders 102 and load bars 104 that extend and lower elongated pins 106, allows the single-level bladder-pin device 100 to provide the same or a similar density of pins as a multi-level bladder-pin device 100. It also allows for the same or similar functionality for preserving and promoting subcutaneous blood flow in the interstices between elongated pins 106 as well as between the static pins 1300. For example, by inflating and deflating the bladders 102 in an alternating and progressive pattern, an oscillating, wave-like pattern of movement can be created across the elongated pins 106 and static pins 1300, wherein static pins 1300 support the affected area on a patient's body in a location where a bladder 102 is deflated, and wherein elongated pins 106 support the affected area on a patient's body in the location where a bladder 102 is inflated. In that way, the single-level bladder-pin device 100 can massage an affected area on a patient's body and encourage localized capillary and lymphatic blood flow. Similar therapeutic effects may also be achieved by inflating and deflating the bladders 102 in unison with each other so that focused pressure is provided to the affected area on a patient's body in an alternating manner by the static pins 1300 and the elongated pins 106. If that alternating pattern is all that is required in a certain application, all of the elongated pins 106 can be provided on a single load plate 1500 rather than on a plurality of separate load bars 104.

Figure 15:
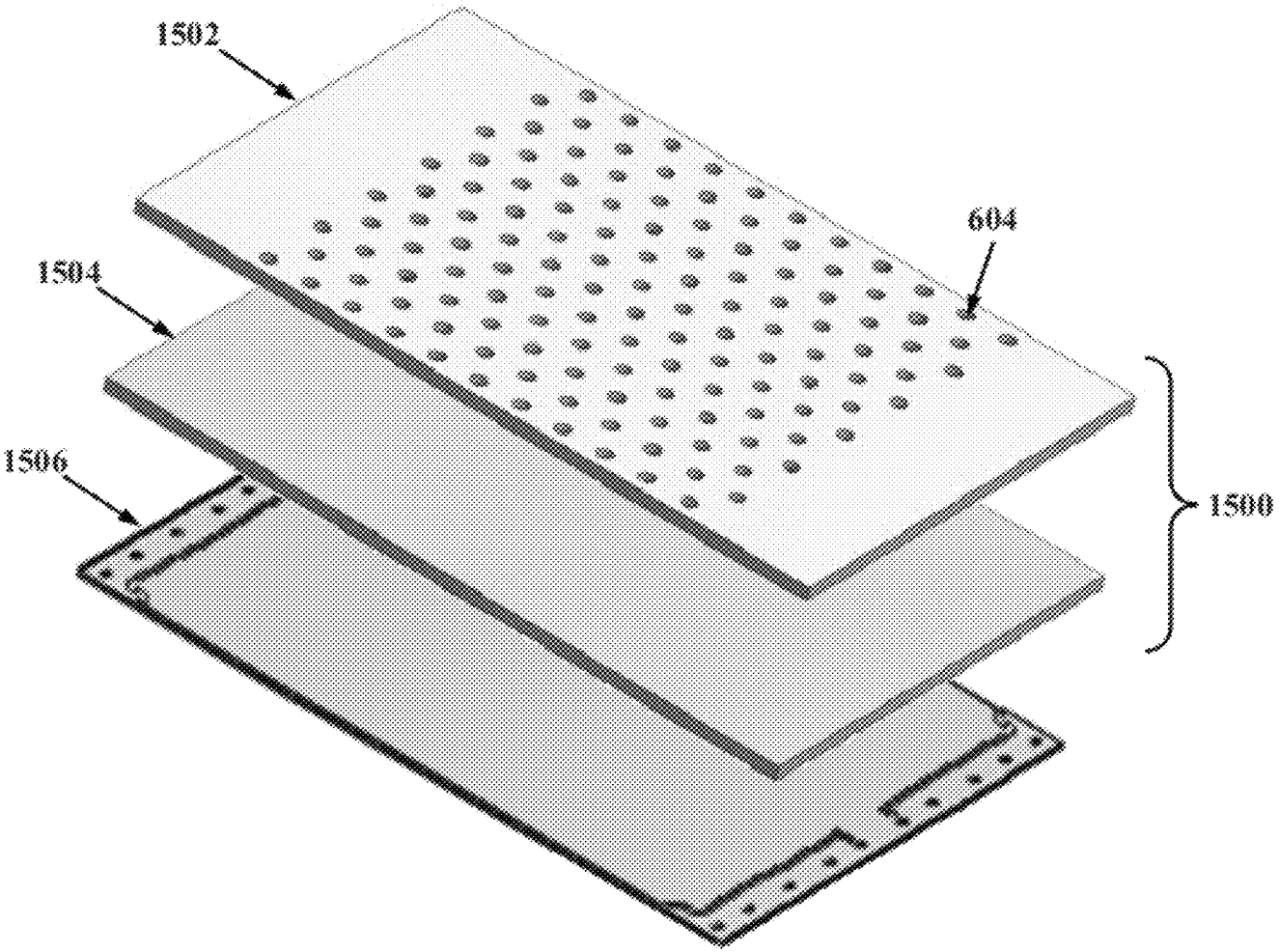
FIG. 15 is an isometric view of a single load plate disposed over a single corresponding bladder according to a non-limiting embodiment of the present invention.

As FIG. 15 illustrates, such a load plate 1500 can be provided with the same features as any of load bars 104 disclosed above, except that those features are repeated in a plurality of (preferably parallel) rows across load plate 1500. By way of example, FIG. 15 illustrates a load plate 1500 in which the features of load bar 104 of FIGS. 6A and 6B are repeated in a plurality of parallel rows. Accordingly, that load plate 1500 includes a hold plate 1502 and a rest plate 1504 that are sandwiched together to hold the cylindrical base portions 302 of the elongated pins 106 therebetween. Like hold plate 600 of the load bar 104 of FIGS. 6A and 6B, hold plate 1502 of load plate 1500 illustrated in FIG. 15 includes a plurality of stepped cylindrical openings 604 (FIG. 6B), each in the shape of an upside down "T", extending therethrough and each configured to receive a cylindrical base portion 302 of an elongated pin 106. These stepped cylindrical openings 604 are repeated in a plurality of parallel rows in load plate 1500. Such a load plate 1500 allows all of elongated pins 106 to be raised and lowered in unison. It also allows fewer bladders, or bladders with fewer branches, to be used to raise and lower elongated pins 106.

As FIG. 15 also illustrates, a single bladder 1506 with a single branch can be used to raise and lower load plate 1500 and, therefore, elongated pins 106. When only a single load plate 1500 and a single bladder 1506 are utilized, only one corresponding channel 200 will be formed in upper-stand off 108. Because only one channel 200 is provided, load plate 1500 can include a plurality of openings (not shown) in which alignment pins 118 are slidably disposed so that, in addition to any guide grooves disposed in the channel 200, alignment pins 118 can help guide load plate 1500 as it is raised and lowered.

Figure 16A:
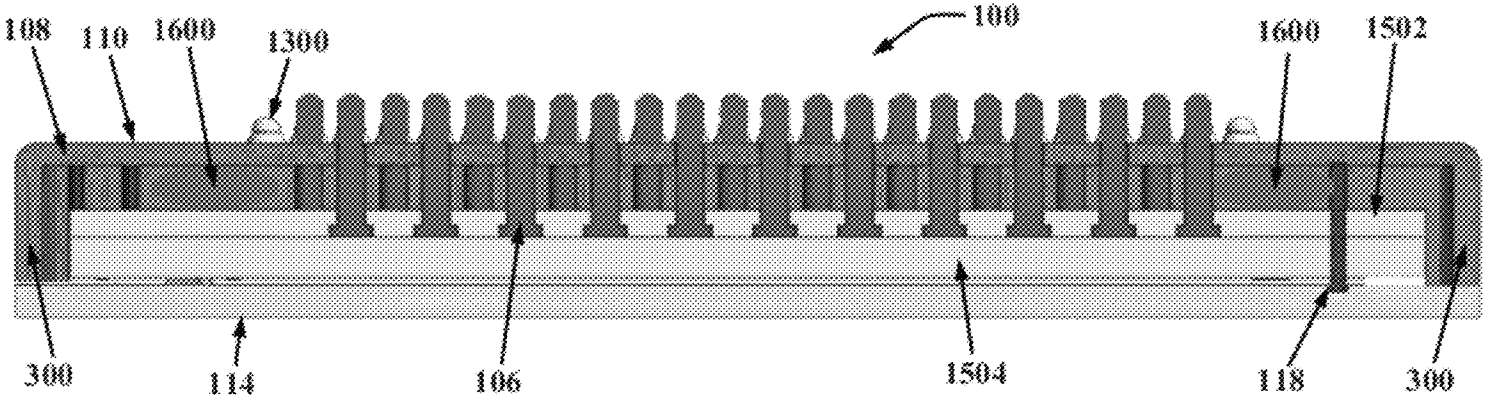
FIGS. 16A and 16B are elevation views, taken in section, of a single-level therapeutic support device according to another non-limiting embodiment of the present invention.
Figure 16B:
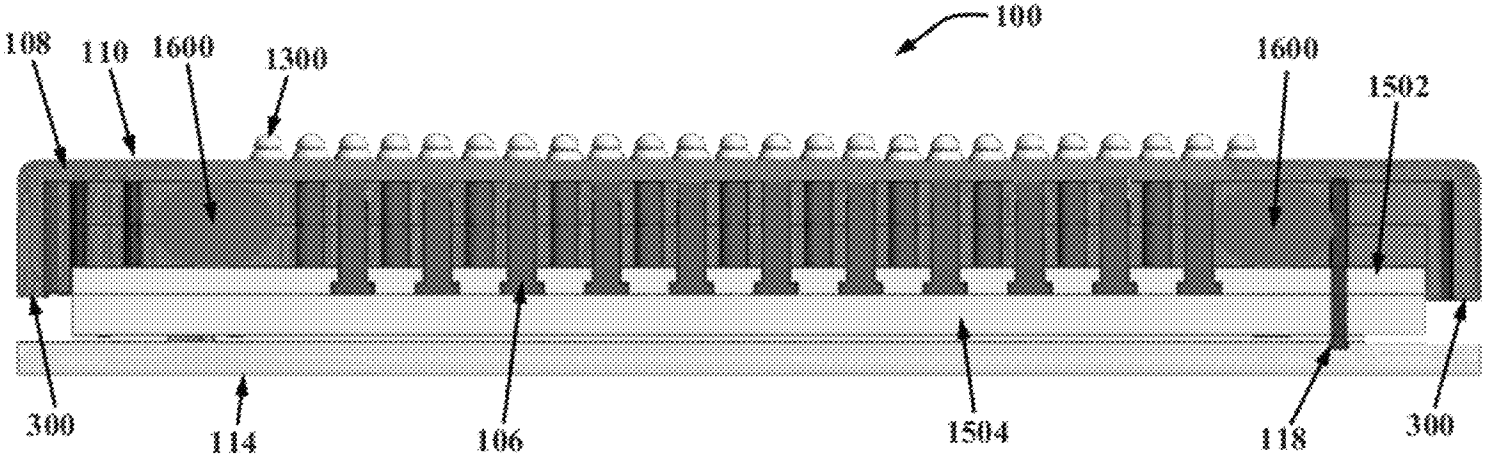

In yet another embodiment of the single-level bladder-pin device 100, all of static pins 1300 can be raised and lowered in unison instead of raising and lowering elongated pins 106 in unison. As FIGS. 16A and 16B illustrate, that is accomplished by raising and lowering top stand-off 108 instead of raising and lowering load plate 1500. Top stand-off 108 can be raised and lowered by placing one or more bladders 1600 between top stand-off 108 and load plate 1500 instead of between load plate 1500 and base plate 114. In the embodiment illustrated in FIGS. 16A and 16B, a pair of bladders 1600 is provided, but any number of bladders 1600 may be provided. If a single bladder 1506 is provided, however, bladder 1600 must include a plurality of openings therein through which the elongated pins 106 can extend. And if fewer bladders 1600 are provided than required to support the entire surface area of the load plate 1500 (e.g., the two bladders of FIGS. 16A and 16B), load plate 1600 will be of sufficient thickness and of a suitably rigid material to transfer pressure uniformly to the elongated pins 106 and to move them in unison as bladder 1600 inflates.

FIG. 16A illustrates single-level bladder-pin device 100 with bladders 1600 deflated, and FIG. 16B illustrates single-level bladder-pin device 100 with bladders 1600 inflated. When bladders 1600 are deflated, vertical walls 300 of top stand-off 108 rest on base plate 114 so as to support top stand-off 108 thereon. In that position, elongated pins 106 extend from upper-most surface 110 of top stand-off 108 by a larger distance than static pins 1300 such that only elongated pins 106 provide focused pressure to a patient's affected body area. When bladders 1600 are inflated, elongated pins 106 slide through openings 112 in top stand-off 108 as top stand-off 108 is raised to a position in which static pins 1300 extend beyond the position of the heads of elongated pins 106. In that position, only static pins 1300 provide focused pressure to a patient's affected body area. Also, bladders 1600 can be inflated to an intermediate position so that the heads of static pins 1300 and elongated pins 106 extend substantially the same distance from the upper-most surface 110 of top stand-off 108 so that all of the pins provide focused pressure to a patient's affected body area. Accordingly, bladders 1600 of single-level bladder-pin device 100 illustrated in FIGS. 16A and 16B can be operated in substantially the same manner as single-level bladder-pin device 100 illustrated in FIGS. 14A and 14B.

Figure 17:
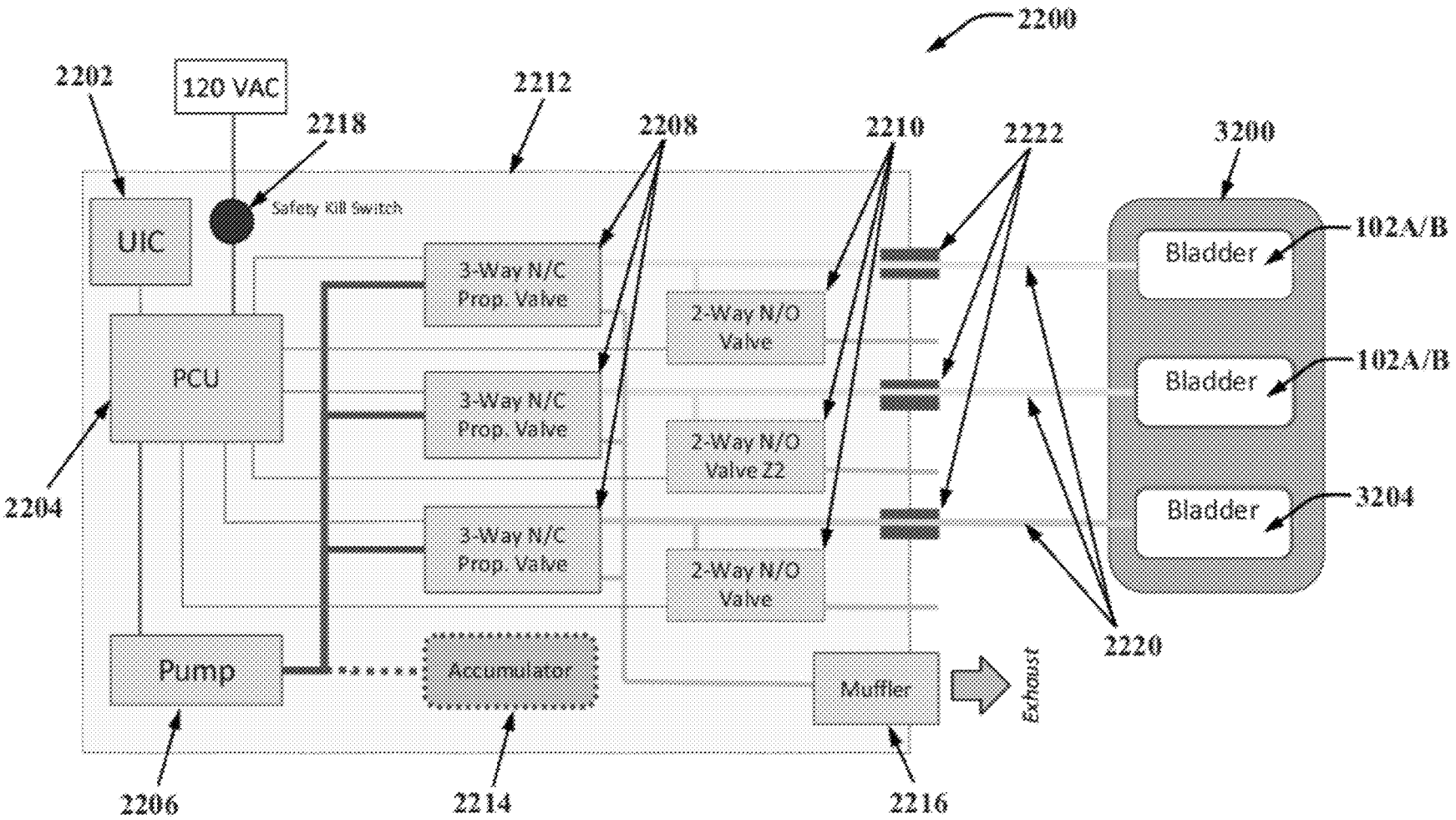
FIG. 17 is a schematic diagram of the therapeutic device of the present invention in combination with various control mechanisms according to a non-limiting embodiment of the present invention.

FIG. 17 illustrates schematically a system 2200 including bladders 102A, 102B and means for controlling thereof. System 2200 can include a user interface console (UIC) 2202 that controls a pneumatic control unit (PCU) 2204. The PCU 2204, in turn, controls a pneumatic pump 2206, a plurality of regulator valves 2208, and a plurality of dump valves 2210 that are in fluid communication with bladders 102A and 102B. A regulator valve 2208 and a dump valve 2210 are provided for each bladder 102A and 102B. The embodiment illustrated in FIG. 17 includes three bladders 102A and 102B and, therefore, a corresponding number of regulator valves 2208 and dump valves 2210. Dump valves 2210 provide a security feature by allowing all of the bladders 102A and 102B to be rapidly deflated in the case of an emergency, such as a need to perform CPR on a patient lying on the device. However, dump valves 2210 may be eliminated if regulator valves 2208 are provided with sufficient reverse flow capacity. In alternate embodiments, regulator valves 2208 and dump valves 2210 could be replaced with a multi-port solenoid valve, and bladder pressure could be controlled by modulating the duty cycle of pump 2206. An accumulator 2214, a muffler 2216, and a safety kill switch 2218 may be provided to store pressurized air as needed to operate system 2200, to silence air as it escapes system 2200, and to shut off power to system 2200, respectively. UIC 2202, PCU 2204, pneumatic pump 2206, regulator valves 2208, dump valves 2210, accumulator 2214, muffler 2216, and safety kill switch 2218 can be provided in a portable case 2212 so that these components may be easily transported as a single unit.

Figure 26:
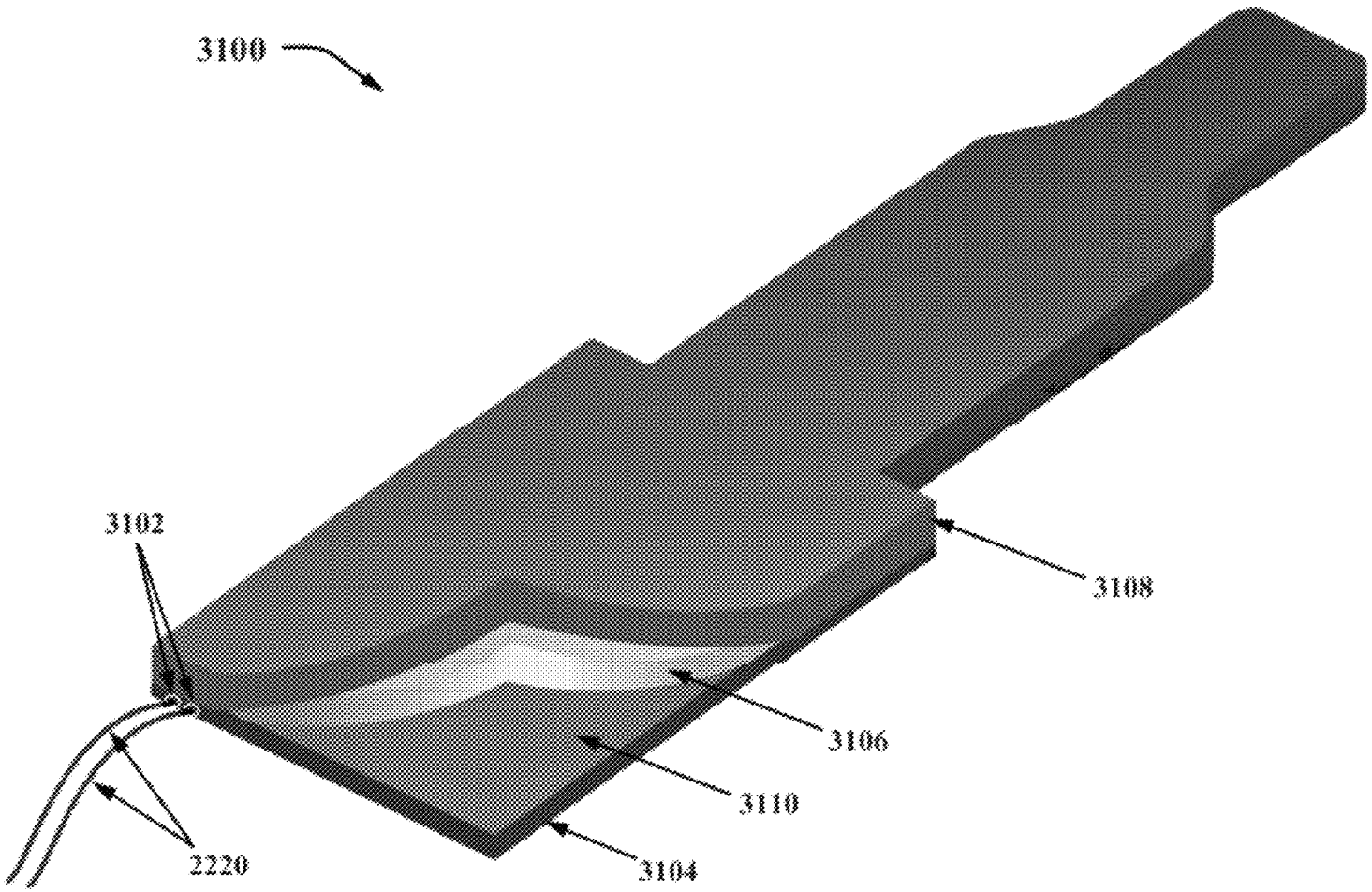
FIG. 26 is an isometric view of a liner bag according to a non-limiting embodiment of the present invention.

Bladders 102A and 102B can be provided in a pad 3200 (see FIG. 27) that is configured to conform to the shape of the table, bed, or medical imaging device with which the therapeutic device 2200 is being used. As disclosed in more detail below, pad 3200 may be provided in a liner bag 3100 (see FIGS. 26-28) to protect therapeutic device 100, as well as to assist in patient comfort. Bladders 102A and 102B in pad 3200 are placed in fluid communication with the fluid components of system 2200 via pneumatic lines 2220 that are connected to the system 2200 via quick disconnect fittings 2222 or otherwise.

Figure 23:
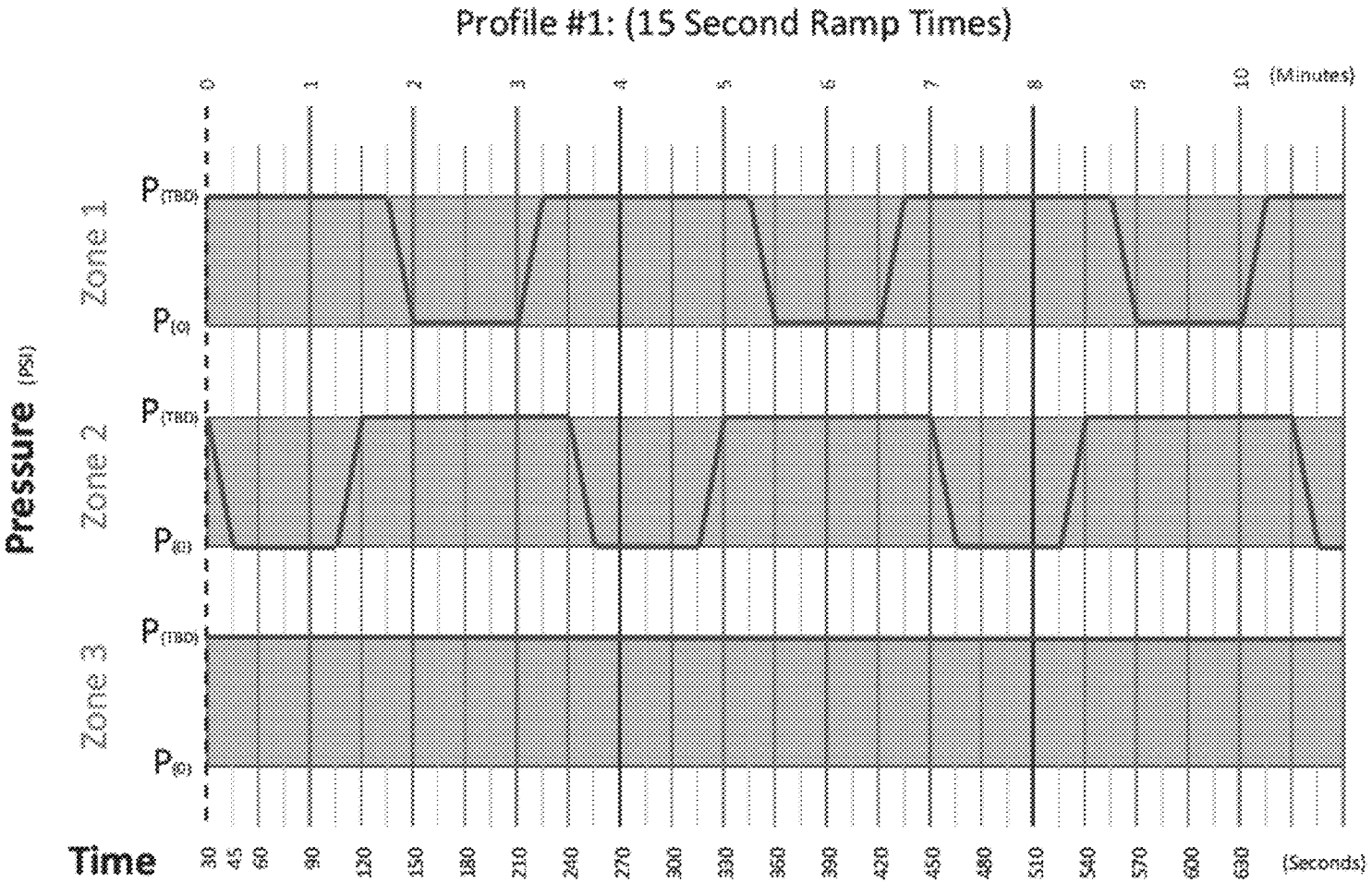
FIGS. 23-25 are graphs illustrating examples of various illustrative predefined patterns and cycles of bladder inflation/deflation of the present invention.

PCU 2204 includes an electronic control unit (ECU) that is controlled by UIC 2202. Via UIC 2202, a user can modify the timing and sequencing of the ECU to program the actuation and dwell of bladders 102A and 102B, which allows the user to define countless patterns and cycles in which pins 106A and 106B are actuated/inflated. As illustrated in FIG. 23, UIC 2202 includes a user interface panel 2300 for the user to interact with the ECU. The user interface of UIC 2202 can be integrated with the ECU, tethered to the ECU, or it can control the ECU wirelessly.

Figure 18:
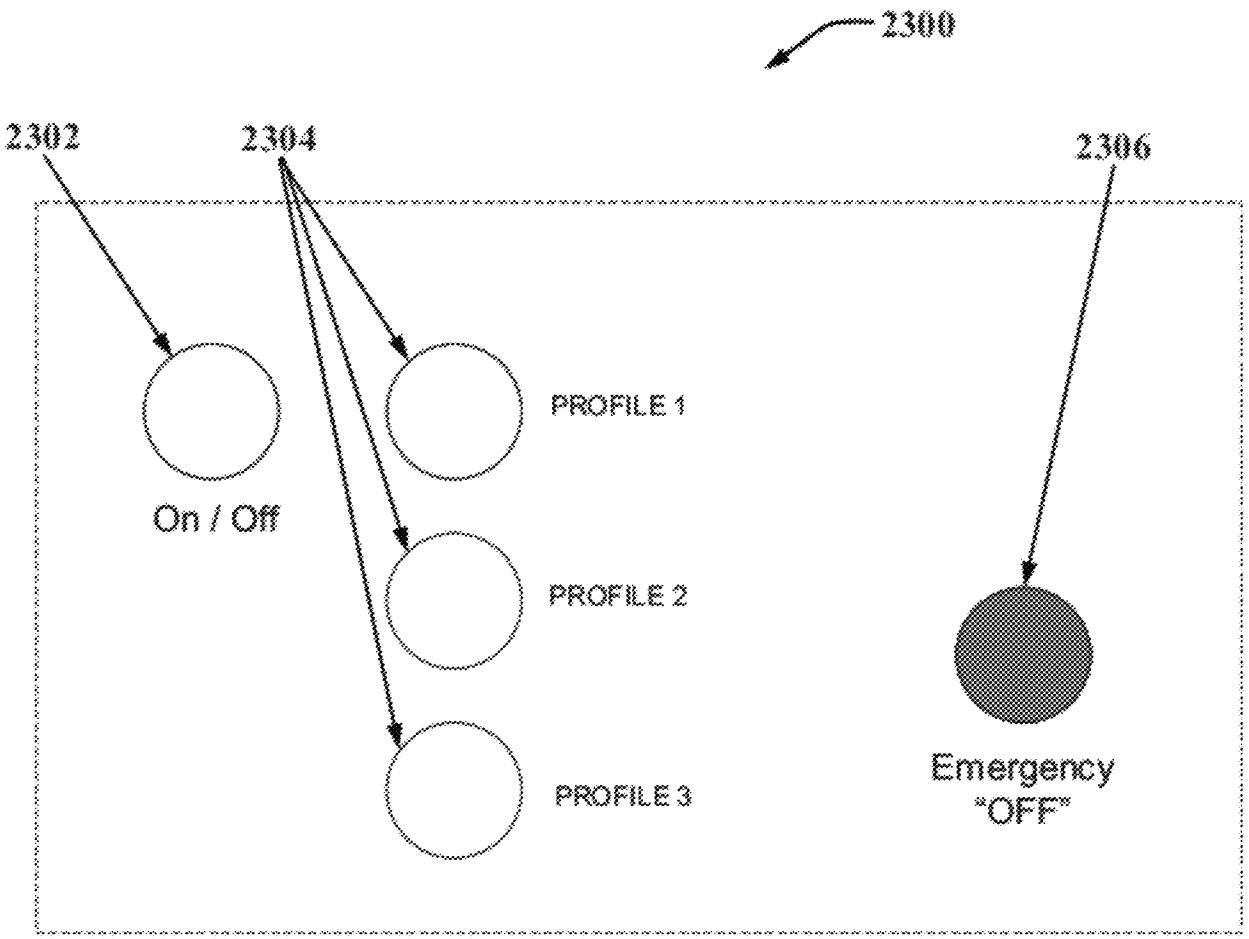
FIG. 18 is a plan view of a user interface according to a non-limiting embodiment of the present invention.

Turning to FIG. 18, user interface panel 2300 of UIC 2202 includes an on/off switch 2302, a plurality of profile switches 2304, and an emergency off switch 2306. On/off switch 2302 allows a user to toggle the therapeutic device on and off. Each of profile switches 2304 is associated with a different, predefined pattern and cycle of bladder 102A and 102B inflation/deflation. The pattern and cycle of inflation/deflation associated with each profile switch 2304 can be started by selecting that profile switch 2304 a first time and stopped by selecting that profile switch 2304 a second time. Emergency stop switch 2306 will automatically turn off and deflate the bladders of system 2200 in the case of an emergency, such as a need to perform CPR on a patient. Each of those switches can include visual, audible, and haptic feedback mechanisms to assist the user in understanding which switches have been selected and how system 2200 is operating. A block diagram illustrating an example of how each of those switches functions is provided in FIG. 19, but any other suitable switch settings may also be utilized in any desired combination.

Figure 19:
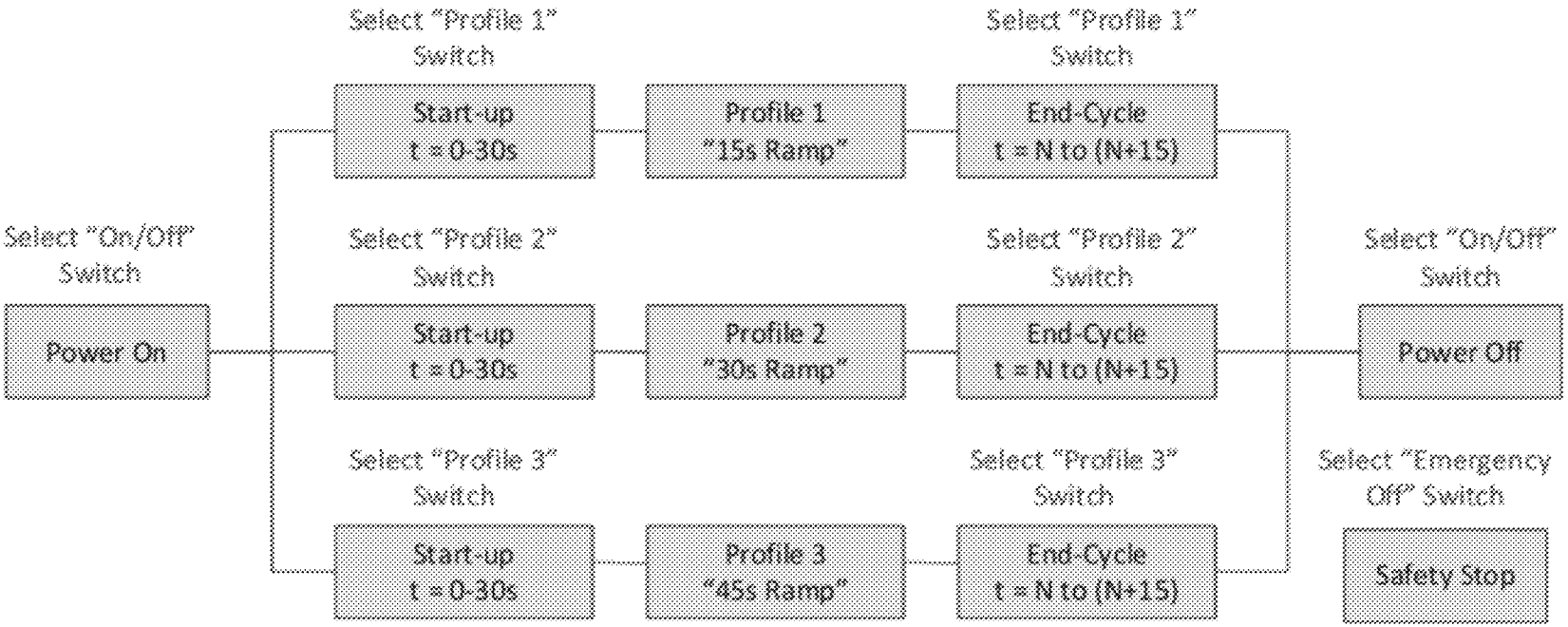
FIG. 19 is a block diagram illustrating how the user interface of FIG. 18 can be used to operate the therapeutic device according to a non-limiting embodiment of the present invention.
Figure 20:
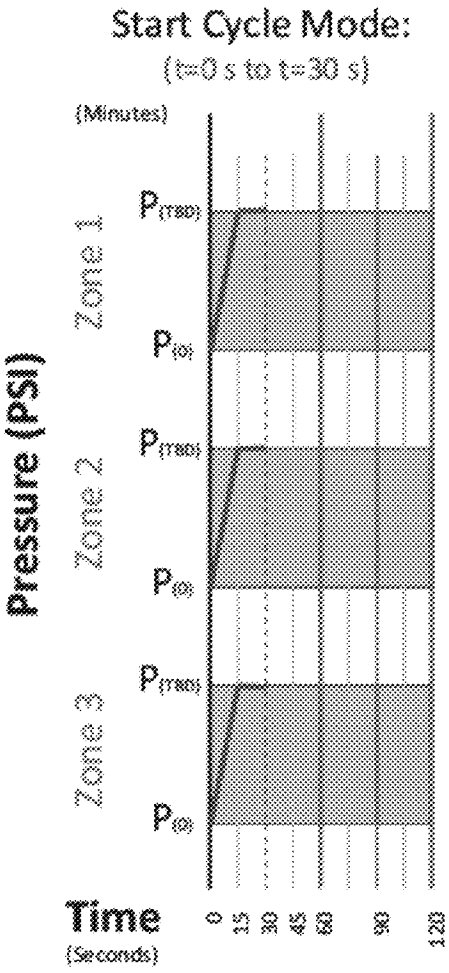
FIG. 20 is a graph illustrating an exemplary start cycle mode of the present invention.
Figure 21:
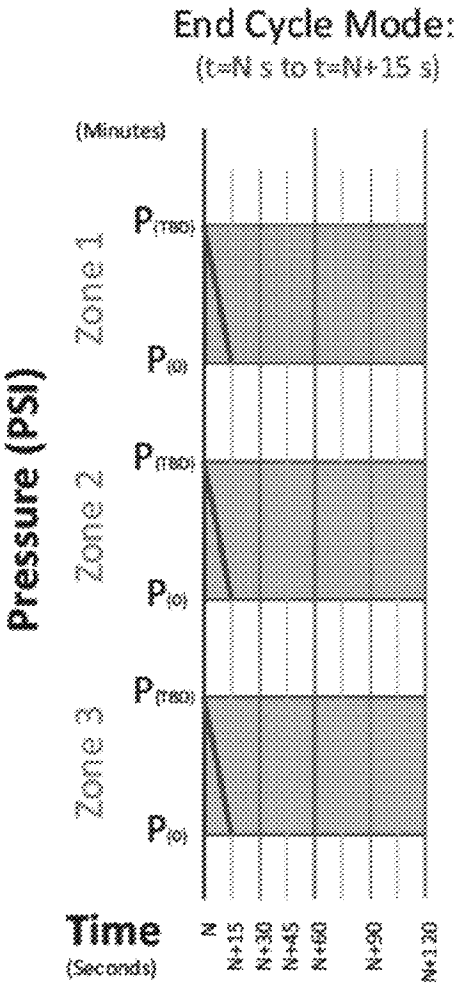
FIG. 21 is a graph illustrating an exemplary end cycle mode of the present invention.
Figure 22:
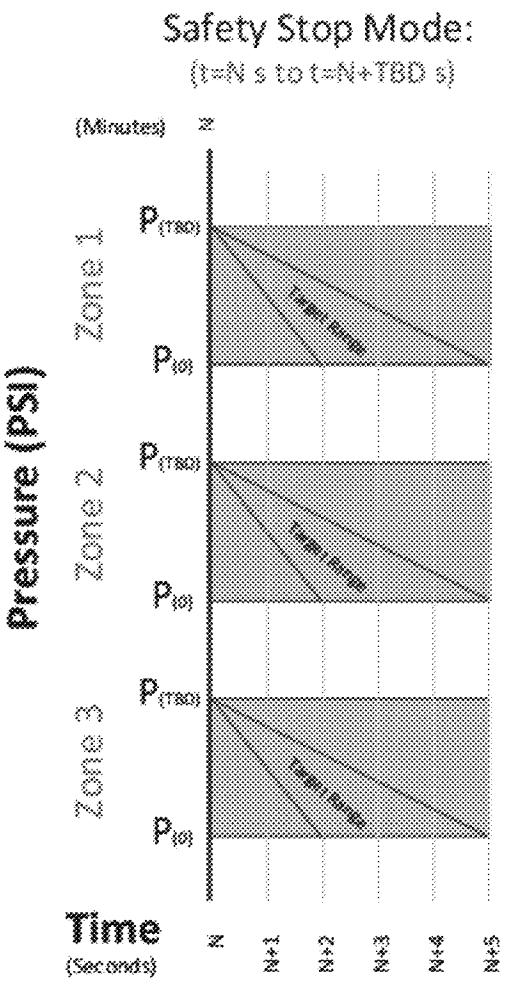
FIG. 22 is a graph illustrating an exemplary safety stop mode of the present invention.
Figure 24:
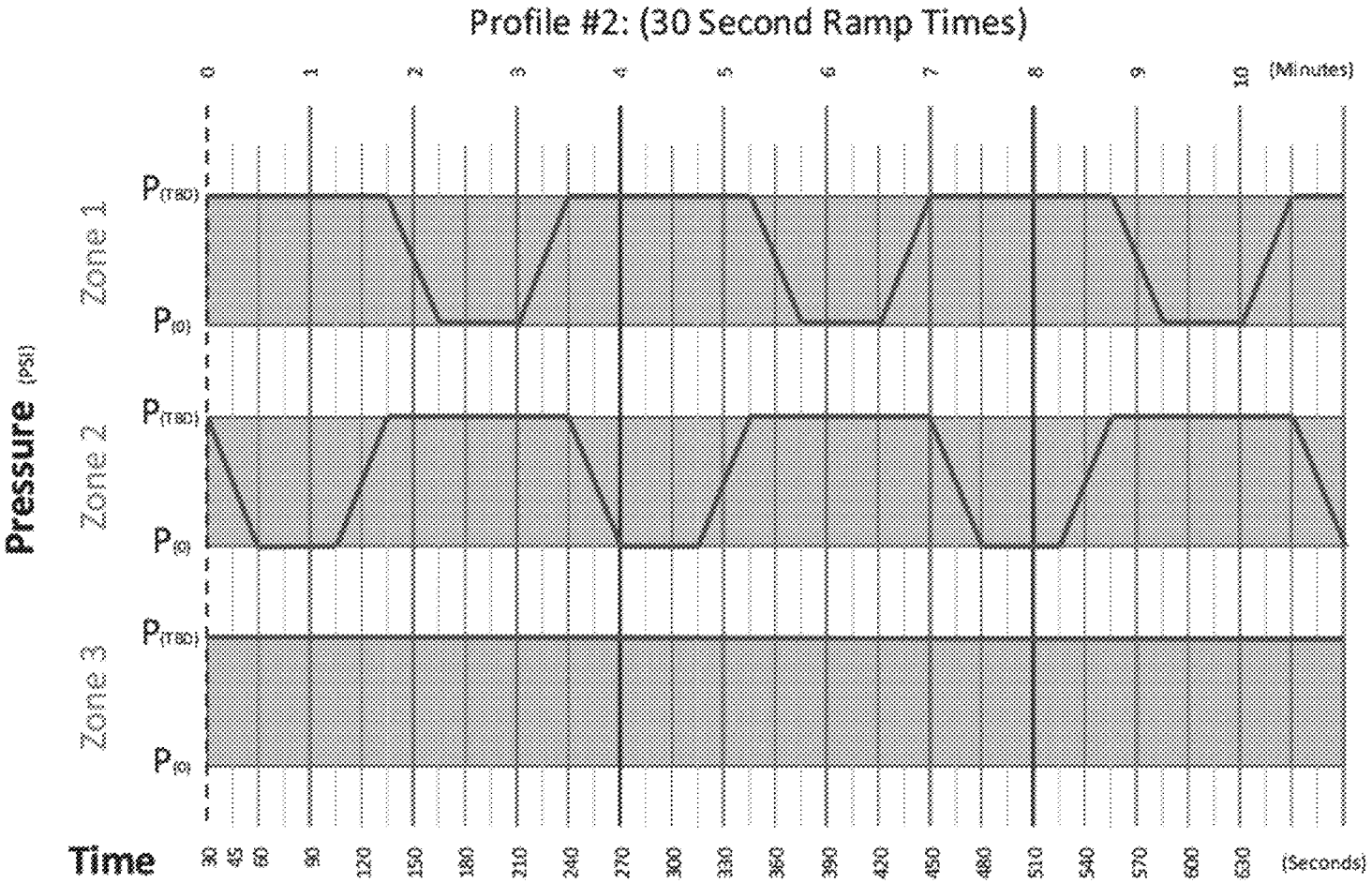
Figure 25:
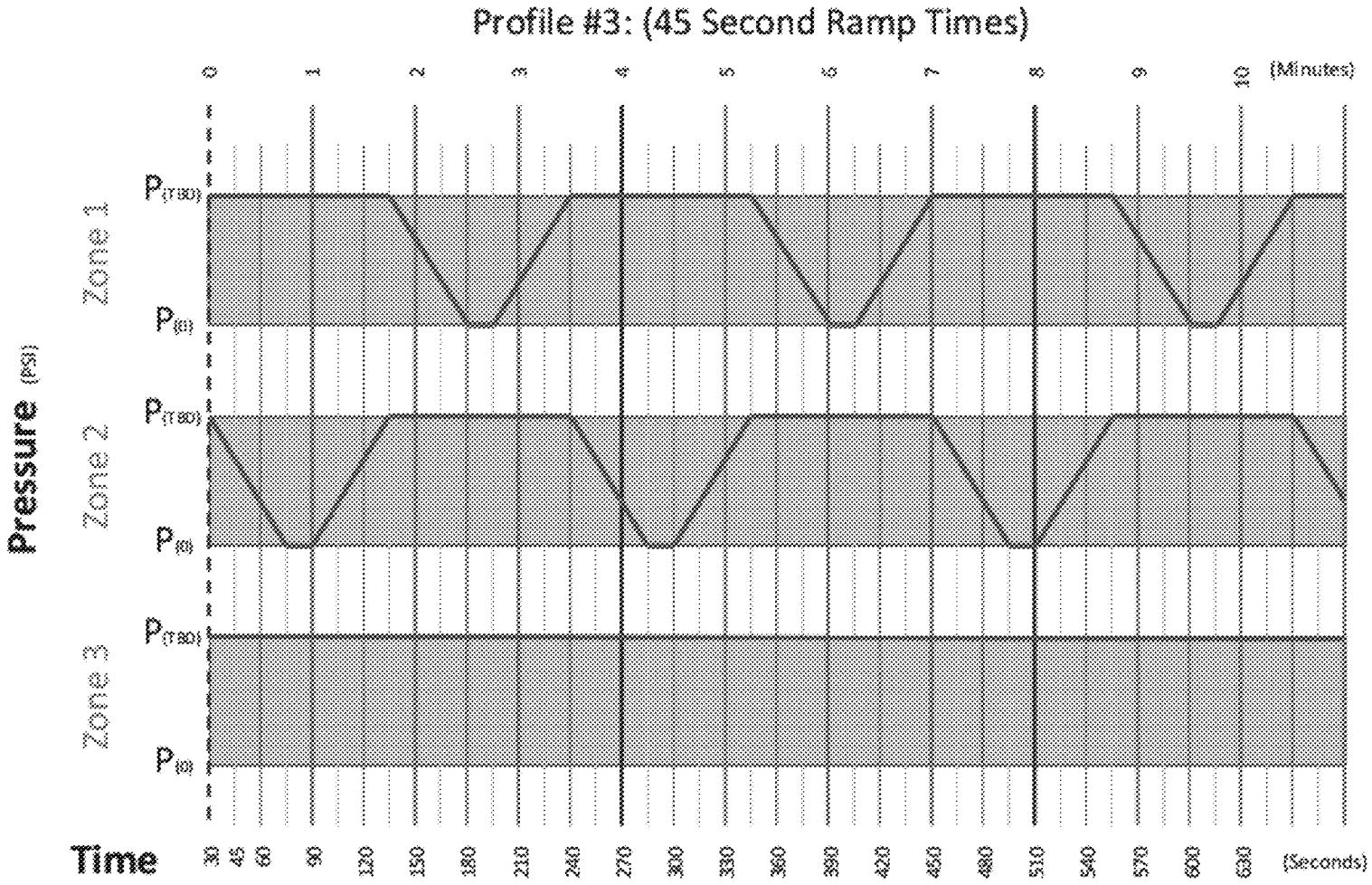

FIGS. 20-25 illustrate examples of different, predefined patterns and cycles of bladder 102A and 102B inflation/deflation described in FIG. 19 (i.e., the inflation/deflation times and patterns for "Profile 1", "Profile 2", and "Profile 3"). As FIG. 20 illustrates, all of bladders 102A and 102B are inflated when system 2200 is turned on, which takes about 15 seconds. Then, after another 15 seconds, one of the patterns and cycles can begin. As FIG. 21 illustrates, all of bladders 102A and 102B are deflated after a pattern and cycle of inflation/deflation is complete, which also takes about 15 seconds—unless the pattern and cycle is stopped when the bladders 102A and 102B are not fully inflated, in which case it will take less than 15 seconds. As FIG. 22 illustrates, if an emergency arises, all of bladders 102A and 102B can be deflated in 5 seconds or less by hitting the emergency off switch 2306. FIG. 23 illustrates the pattern and cycle associated with first profile switch 2304 ("Profile 1"); FIG. 24 illustrates the pattern and cycle associated with second profile switch 2304 ("Profile 2"); and FIG. 25 illustrates the pattern and cycle associated with third profile switch 2304 ("Profile 3"). Although each of those figures illustrates linear inflation and deflation rates, such linearity is not required.

Although user interface panel 2300 is described above as providing for only three specific different, predefined patterns and cycles of inflation/deflation, user interface panel 2300 and UIC 2202 could be adapted to allow a user to define, store, and actuate any number of other patterns and cycles of inflation/deflation as well as for full manual operation of which bladders 102A and 102B are deflated and inflated. UIC 2202 provides the main point of input from the doctor, nurse, or patient and controls the patterns and cycles of inflation/deflation by controlling solenoids that open and close regulator valves 2208 and dump valves 2210. It also controls pressure regulators that determine the pressures in the bladders 102A and 102B as well as operation of the pneumatic pump 2206. UIC 2202 can also be programmed to monitor, control, and collect data from sensors that examine load, pressure, temperature, and moisture, with or without respect to time.

The operation of UIC 2202 and PCU 2204 are preferably implemented by any suitable computing processor or processing platform that is capable of performing the functions and operations in accordance with the invention. Each of those devices may include a user interface and/or display for operating the computing processor or processing platform. All or parts of the system and processes can be stored on or read from a memory or computer readable media.

UIC 2202, PCU 2204, and pneumatic pump 2206 may be battery powered (VDC) or wall outlet powered (VAC). In operation, therapeutic device 2200 and its various components preferably, but not necessarily, maintain a noise level lower than 40 dB and can cycle a 400 pound load at least 10,000 times. Preferably but not necessarily, the maximum current draw of each component is 5 amps.

Figure 27:
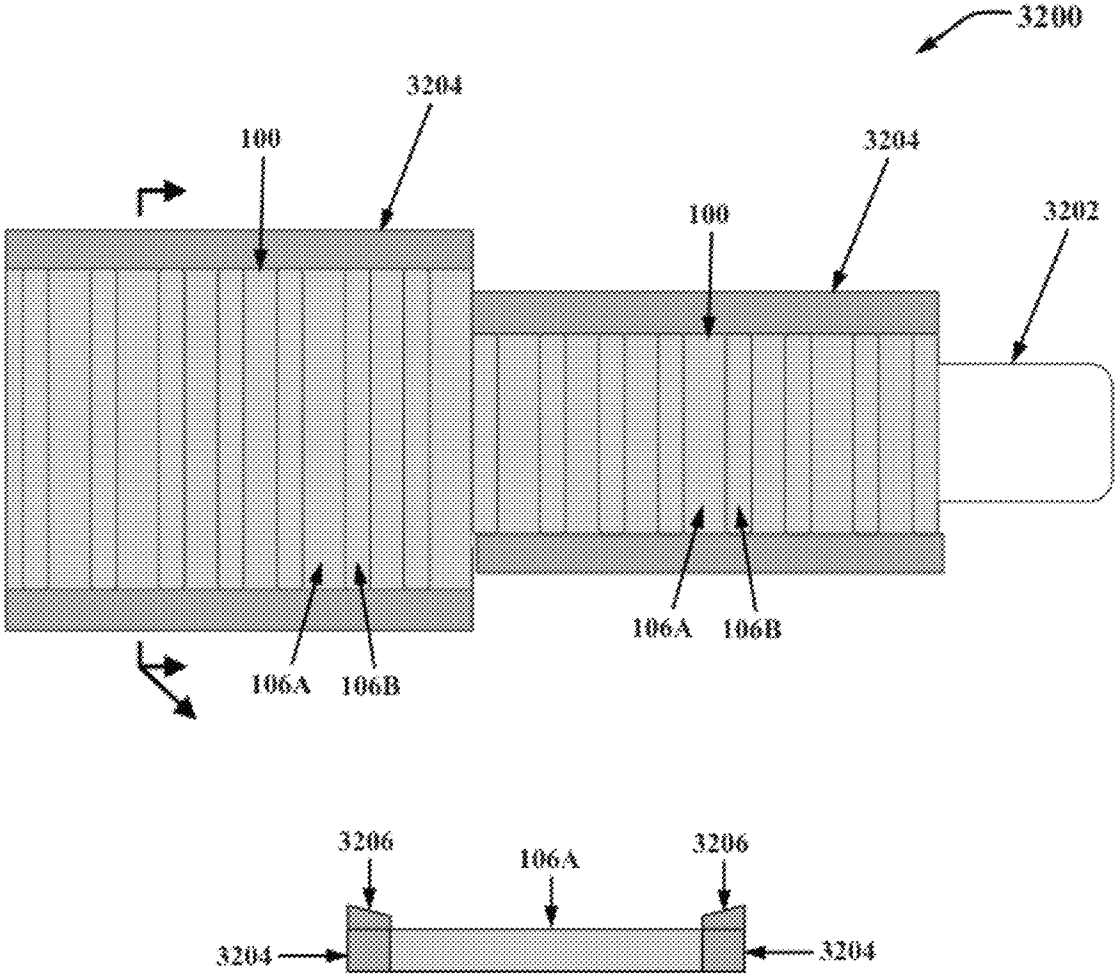
FIG. 27 is a plan view of a pad, with a section view also shown, according to a non-limiting embodiment of the present invention.

In addition to the components disclosed above, system 2200 may also include a double thickness liner bag 3100 (FIG. 26), a foam mat (not shown), a head rest 3202 (FIG. 27), inflatable side bladders 3204 (FIG. 27), and a dynamic edge rail 3206 (FIG. 27). Liner bag 3100 surrounds the various patient-supporting components of system 2200 to form pad 3200. Those patient-supporting components include bladder-pin device 100, the foam mat, the head rest 3202, the inflatable side bladders 3204, and the dynamic edge rail 3206. The liner bag 3100 is designed to close around those patient-supporting components with a (preferably medical grade) ziploc or zipper system (not shown) that allows for easy disassembly of top and bottom portions for quick maintenance and/or replacement.

Liner bag 3100 assists in patient comfort and protects the patient-supporting components of system 2200 while allowing smooth actuation of elongated pins 106 and/or static pins 1300. Accordingly, liner bag 3100 is specifically designed to allow for slip between layers that provide low friction across its surfaces as well as elasticity so as to not impair the performance of pin-bladder devices 100 housed therein. Also, liner bag 3100 stretches in a manner that allows for the patient's weight to be supported by the elongated pins 106 and/or static pins 1300 without the bag being ripped or torn. Liner bag 3100 is also impervious to various fluids so as to protect the patient-supporting components of system 2200 against the ingress of foreign matter, such as urine, feces, blood, and alcohol. It can be used more than once because it can be removed and cleaned, and it can also be cleaned without being removed using inflatable side bladders 3204 to pull the surface of liner bag 3100 tight.

Liner bag 3100 includes sealing grommets 3102 that allow pneumatic lines 2220 to be connected between inflatable bladders 102A, 102B, and/or 3204 and pneumatic pump 2206; a non-slip bottom layer 3104 and straps (not shown) that hold the device securely to the table, bed, or medical imaging device on which it is being used; an inner protective layer 3106 for protecting the patient-supporting components within the liner bag 3100 and preventing the liner bag 3100 from ripping or tearing; and a stretchable outer layer 3108 that stretches as the elongated pins 106 and/or static pins 1300 press against the liner bag 3100. Non-slip bottom layer 3104 is preferably a fabric that holds up strongly to wear and abrasion while also offering grip and non-skid in both wet and dry conditions, such as the SLIP-NOT brand fabric made by Eastex Products, Inc.; inner protective layer 3106 is preferably a nylon-reinforced rip-stop material; stretchable outer layer 3108 is preferably a fluid-proof and stain-resistant fabric that stretches in the two directions perpendicular to the plane of the fabric, such as the TEK STRETCH 2 brand fabric made by Eastex Products, Inc.; and the strap is preferably made of nylon and can preferably support a 200 pound retention load. Liner bag 3100 may also include an inner slip/shear reducer 3110 disposed between the non-slip bottom layer 3104 and the inner protective layer 3106 to reduce slip/shear between those layers.

Figure 28:
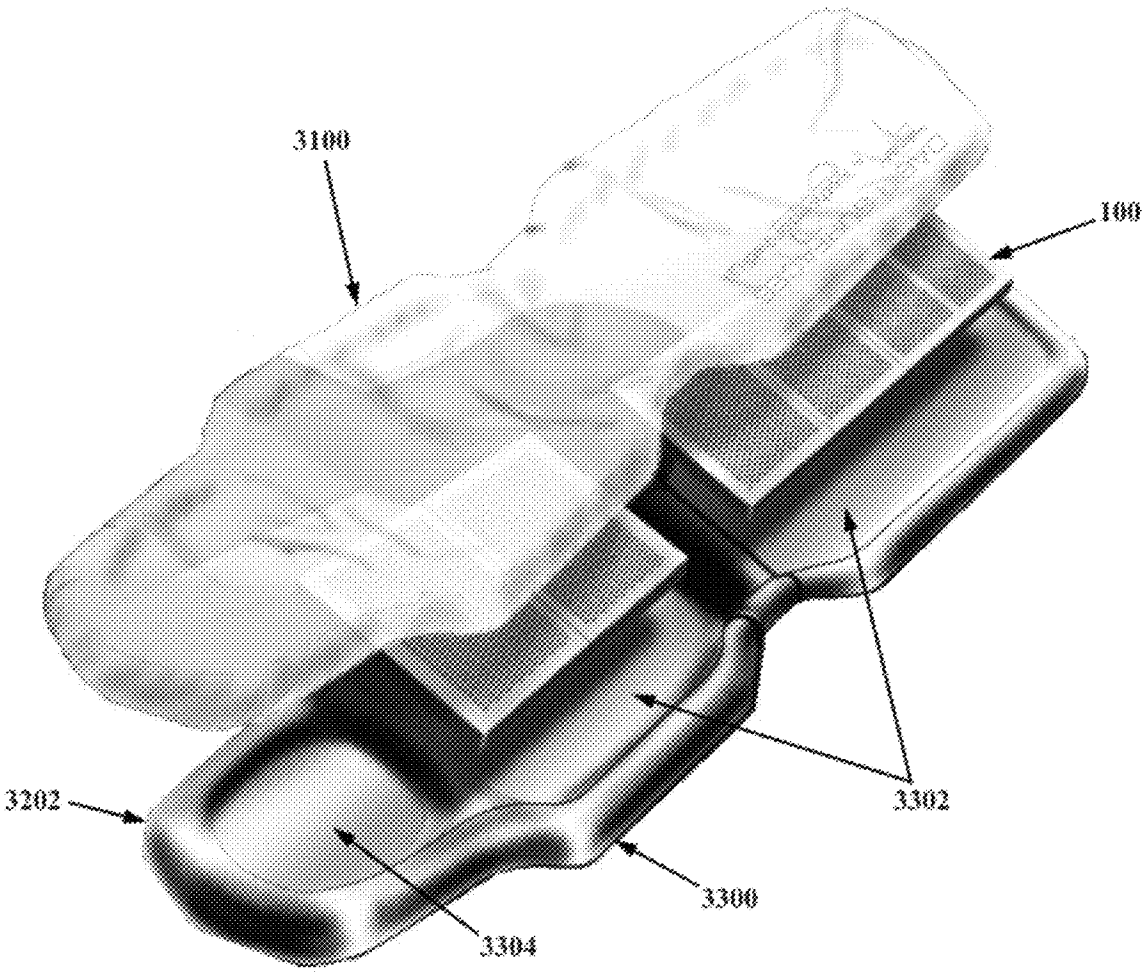
FIG. 28 is an isometric view of a liner bag and foam insert in combination with the therapeutic device of FIG. 1.

FIGS. 27 and 28 illustrate an example of the patient-supporting components that can be enclosed in liner bag 3100. In the exemplary embodiment of pad 3200 illustrated in FIG. 27, a plurality of bladder-pin devices 100 are assembled in the shape of a cath table, except for the head rest 3202, which is formed from a durable soft material. Bladder pin devices 100 are arranged so that elongated pins 106A, 106B extend from side to side in alternating rows. Pad 3200 also includes inflatable side bladders 3204 disposed along the sides of bladder-pin devices 100. Inflatable side bladders 3204 are provided as a third support zone substantially perpendicular to the alternating rows of elongated pins 106A, 106B and are approximately 1½ inches wide and 1½ inches thick. The cath table, not including the head rest 3202, is approximately 100 inches long, approximately 24 inches wide at its widest, and approximately 14 inches wide at its narrowest. The three-zone configuration corresponds to the three-zone configuration of FIG. 17, and those dimensions correspond to the typical dimensions of a cath table. However, other configurations, other dimensions, and other flow rates may be used as required to suit other applications and to fit different tables, beds, and medical imaging devices.

Inflatable side bladders 3204 can be inflated as part a cleaning mode for the liner bag 3100. The cleaning mode stretches the liner bag 3100 to remove any wrinkles or folds from it so that the entire external surface of the liner bag 3100 can be more easily cleaned. Side bladder 3204 can also incorporate a secondary chamber to provide a dynamic edge rail 3206.

Alternatively, dynamic edge rail could be a separate structure attached to side bladder 3204, device 100 or a related component. Dynamic edge rail 3206 can comprise a fourth inflatable zone that can be inflated or deflated as desired, for example, to provide side bolstering for a patient. Alternatively, dynamic edge rail 3206 can be formed from a durable soft material that is attached at the sides of the bladder-pin device 100. Additional inflatable structures could be provided in the form of pillows or other support devices. System 2200 could be adapted to control the inflation and deflation of these additional inflatable structures.

As an alternative to forming therapeutic device 100 in the shape of the load-bearing device on which it will be used, therapeutic device 100 can be made in a standard, modular configuration and disposed in a foam insert 3300 that is formed in the shape of the load-bearing device on which therapeutic device 100 will be used. Thus, instead of making different several therapeutic devices 100 to conform to the shape of different load bearing devices, foam insert 3300 can be formed to the shape of different load-bearing devices. It is easier and less costly to modify the shape of the foam insert 3300 for each different load-bearing device than to modify therapeutic devices 100. Foam insert 3300 is preferably made from a medium density medical grade cellular urethane foam, such as the PORON brand foam made by Stockwell Elastomerics, Inc. Different and/or additional materials may also be used to construct the liner bag 3100 depending on the application and the desired attributes of the liner bag 3100.

As illustrated in FIG. 27, foam insert 3300 is formed with recessed portions 3302 that are configured to receive one or more of the modular therapeutic devices 100 therein. Head rest 3202 is formed with a recessed portion 3204 that is configured to receive different patient head supports 3206 therein. Those recessed portions 3302 and 3304 act as nestable pockets that hold the therapeutic devices 100 and the head supports 3306 in place on the load-bearing device on which they are being used. Therapeutic devices 100 can be used with different foam inserts 3300 to conform to different load-bearing devices without the need to make different sizes and configurations of the therapeutic devices 100 for each different load-bearing device on which they will be used. Patient head supports 3206 can be of different shapes and sizes to support heads of different sizes and shape and to provide different types of support.

Each of bladders 102A, 102B may be provided with means, for example, a one-time programmable (OTP) chip including the bladder's serial number, for self-identification when connected to a control system, as well as means, for example, an erasable programmable memory (EPROM) for storing other information relevant to the bladder, for example, the number of inflation/deflation cycles it has been subjected to. The control system could be configured to not operate a bladder if the control system does not recognize the bladder's serial number or if it determines that the bladder has been used for an excessive number of cycles.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A therapeutic support device comprising:

a first stand-off with a plurality of first openings formed therein, said plurality of openings being configured to slidably receive a plurality of first pins;

at least one load bar slidably disposed in the first stand-off, the plurality of first pins being disposed in at least one row on said at least one load bar;

at least one first bladder configured to move the first stand-off and the at least one load bar relative to one another such that the plurality of first pins slide through the plurality of first openings in the first stand-off when the at least one first bladder is inflated and deflated, wherein the plurality of first pins slide through the plurality of first openings between a first position in which they extend from the first stand-off and provide focused pressure to an area of a patient's body and a second position wherein they are retracted to be substantially flush with the first stand-off.

2. The therapeutic support device of claim 1, wherein said at least one load bar is disposed between said at least one first bladder and said plurality of first pins.

3. The therapeutic support device of claim 1, said first stand-off comprising at least one first channel configured to receive at least a portion of said at least one first bladder.

4. The therapeutic support device of claim 3, wherein said at least one load bar is slidably engaged with said at least one first channel.

5. The therapeutic support device of claim 1, further comprising a base plate, said at least one first bladder disposed between said first stand-off and said base plate.

6. The therapeutic support device of claim 1, said first stand-off further comprising a plurality of second openings therein, said plurality of second openings configured to slidably receive a plurality of second pins, said therapeutic support device further comprising at least one second load bar, the plurality of second pins being disposed in at least one row on said at least one second load bar, and at least one second bladder configured to move the at least one second load bar with respect to the first stand-off when the at least one second bladder is inflated and deflated.

7. The therapeutic support device of claim 6 further comprising a second stand-off having a plurality of openings configured to slidably receive said plurality of second pins.

8. The therapeutic support device of claim 7, said second stand-off comprising at least one second channel configured to receive at least a portion of said at least one second bladder.

9. The therapeutic support device of claim 8, wherein said at least one second load bar is slidably engaged with said at least one second channel.

10. The therapeutic support device of claim 6, said at least one first bladder disposed between said first stand-off and said second stand-off.

11. The therapeutic support device of claim 6, further comprising a base plate, said at least one second bladder disposed between said second stand-off and said base plate.

12. The therapeutic support device of claim 6, configured such that said at least one first bladder and said at least one second bladder are independently inflatable and deflatable.

13. The therapeutic support device of claim 6, wherein said at least one second bladder comprises a plurality of second bladders.

14. The therapeutic support device of claim 1, further comprising a plurality of static support pins extending outwardly from an outer surface of said first stand-off.

15. The therapeutic support device of claim 1, wherein ones of said plurality of first pins are about 8 mm in diameter and are spaced about 20-25 mm from each other.

16. The therapeutic support device of claim 1, wherein said at least one first bladder comprises a plurality of first bladders.

17. The therapeutic support device of claim 16, wherein said at least one second bladder comprises a plurality of second bladders.

18. The therapeutic support device of claim 1, further comprising at least one first valve in fluid communication with said at least one first bladder and configured to selectively enable inflation and deflation of said at least one first bladder.

19. The therapeutic support device of claim 18, further comprising a pump configured to selectively inflate said at least one first bladder.

20. The therapeutic support device of claim 19, further comprising a control system configured to control the operation of said pump and said at least one first valve.

21. A therapeutic support device comprising:

a first stand-off with a plurality of channels and a plurality of pin holes formed therein, said plurality of pin holes being formed at a top surface and a bottom surface of the first stand-off;

a second stand-off disposed below the first stand-off with a plurality of channels and a plurality of pin holes formed therein, said plurality of pin holes being formed at a top surface of the second stand-off;

a plurality of inflatable bladders disposed in the plurality of channels of the first stand-off and the second stand-off;

a plurality of load bars disposed on top of the inflatable bladders in the plurality of channels of the first stand-off and the second stand-off;

a plurality of first pins disposed on top of each load bar disposed in the plurality of channels of the first stand-off and extending through the plurality of pin holes formed at the top surface of the first stand-off;

a plurality of second pins disposed on top of each load bar disposed in the plurality of channels of the second stand-off and extending through the pin holes formed at the bottom surface of the first stand-off and the pin holes formed in the top surface of the second stand-off; and a pump configured to inflate the plurality of inflatable bladders, wherein the plurality of first pins and the plurality of second pins extend from the top surface of the first stand-off when the inflatable bladders are inflated so as to reduce localized subcutaneous pressure while allowing capillary flow.

* * * * *

UNITED STATES PATENT AND TRADEMARK OFFICE

CERTIFICATE OF CORRECTION

PATENT NO. : 8,863,338 B2
APPLICATION NO. : 13/152033
DATED : October 21, 2014
INVENTOR(S) : Dzioba et al.

It is certified that error appears in the above-identified patent and that said Letters Patent is hereby corrected as shown below:

In the Claims claim 1, at column 14, line 55, add the word –first– before the word "openings".

Signed and Sealed this
Third Day of February, 2015

Michelle K. Lee

Michelle K. Lee
*Deputy Director of the United States Patent and Trademark Office*